US005561021A

United States Patent [19]

Yamazaki et al.

[11] Patent Number: 5,561,021

[45] Date of Patent: Oct. 1, 1996

[54] ELECTROPHOTOGRAPHIC PHOTOSENSITIVE MEMBER HAVING A METAL OXIDE MATERIAL LAYER WITH AN IMPROVED WATER REPELLENCY FORMED ON THE SURFACE OF A LIGHT RECEIVING LAYER

[75] Inventors: Koji Yamazaki; Shigenori Ueda, both of Nara; Toshiyuki Ehara, Yokohama; Hiroaki Niino; Masaya Kawada, both of Nara, all of Japan

[73] Assignee: Canon Kabushiki Kaisha, Tokyo, Japan

[21] Appl. No.: 361,557

[22] Filed: Dec. 22, 1994

[30] Foreign Application Priority Data

Dec. 22, 1993 [JP] Japan ..... 5-324259
Dec. 15, 1994 [JP] Japan ..... 6-311786

[51] Int. Cl.[6] ..... G03G 5/147

[52] U.S. Cl. ..... 430/130; 430/66; 430/67; 430/132

[58] Field of Search ..... 430/66, 67, 130, 430/132

[56] References Cited

U.S. PATENT DOCUMENTS 4,786,574 11/1988 Shirai et al. ..... 430/66
4,932,859 6/1990 Yagi et al. ..... 430/66
4,965,154 10/1990 Karakida et al. ..... 430/58
5,153,086 10/1992 Yagi et al. ..... 430/58
5,183,719 2/1993 Yagi et al. ..... 430/66
5,324,609 6/1994 Yagi et al. ..... 430/66
5,447,812 9/1995 Fukuda et al. ..... 430/66

*Primary Examiner*—Richard L. Schilling
*Attorney, Agent, or Firm*—Fitzpatrick, Cella, Harper & Scinto

[57] ABSTRACT

An electrophotographic photosensitive member comprising a substrate, a light receiving layer having a photoconductive layer composed of a non-single crystal material containing silicon atoms as a matrix and having photoconductivity disposed on said substrate, and a surface protective layer disposed on said light receiving layer, characterized in that said surface protective layer comprises a metal oxide film formed by adjusting the surface of said light receiving layer to have a contact angle against water of 80° or more, applying a sol liquid comprising an organometallic compound admixed with water, an alcohol and an acid onto the surface of said light receiving layer, and subjecting the resultant to heat treatment. An electrophotographic apparatus provided with said electrophotographic photosensitive member. A process for the production of said electrophotographic photosensitive member.

30 Claims, 17 Drawing Sheets

ELECTROPHOTOGRAPHIC PHOTOSENSITIVE MEMBER HAVING A METAL OXIDE MATERIAL LAYER WITH AN IMPROVED WATER REPELLENCY FORMED ON THE SURFACE OF A LIGHT RECEIVING LAYER

BACKGROUND OF THE INVENTION

1. Field of the Invention

The present invention relates to an improved electrophotographic photosensitive member having a protective layer comprising a specific metal oxide thin film, which is highly sensitive to electromagnetic waves such as light (which herein means in a broad sense those lights such as ultraviolets rays, visible rays, infrared rays, X-rays, and γ-rays and which prevents occurrence of a filming and provides an improvement in the transfer efficiency and also in the utilization efficiency of a developer in the electrophotographic image-forming process, wherein high quality image reproduction is assurred. The present invention also relates to an electrophotographic apparatus such as a copying machine, a laser beam printer, or the like which comprises said electrophotographic photosensitive member, a charging means, an exposure means, a developing means and a cleaning means and in which image formation is conducted by way of an electrophotographic process. The present invention includes a process for the production of said electrophotographic photosensitive member.

2. Related Background Art

There have been provided a variety of photosensitive members for electrophotography each having a light receiving layer comprised of a non-single crystal material containing silicon atoms as a matrix such as an amorphous silicon material (hereinafter referred to as a-Si material). For simplification purpose, the photosensitive member for electrophotography will be hereinafter referred to as electrophotographic photosensitive member, and the photosensitive member having a light receiving layer comprised of an a-Si material will be hereinafter referred to as a-Si electrophotographic photosensitive member.

Such electrophotographic photosensitive members have been evaluated as being high in surface hardness, exhibiting a high sensitivity not only against visible light (for example, of from 400 to 700 nm) but also against a semiconductor laser beam of 770 to 800 nm without being deteriorated even upon repeated use over a long period of time, and their surface being capable of being maintained uniform even upon repeated use over a long period of time. In view of this, they have been desirably used as a device for recording, for example, in high speed copying apparatus or laser beam printers in which an electrophotographic technique is utilized.

Now, the foregoing non-single crystal material containing silicon atoms as a matrix used as the light receiving layer in the electrophotographic photosensitive member is generally formed by means of a plasma CVD process in which plasma discharge is caused in a gaseous atmosphere composed of, for example, silane gas, and if necessary, hydrogen gas, a dopant-imparting raw material gas, or other raw material gas to thereby decompose these gases whereby forming a film comprised of a silicon-containing non-single crystal material on a substrate made of aluminum for example. The reason why the plasma CVD process is often employed in the formation of the light receiving layer of the photosensitive member is that the plasma CVD process enables to uniformly form a film having a uniform thickness and a homogeneous property over the entire surface of a large area substrate such as a cylindrical substrate.

In the case of the a-Si electrophotographic photosensitive member, it is desired to have a surface protective layer in order to prevent occurrence of a unfocused image when image formation is conducted under high humidity environmental conditions. Such surface protective layer is usually composed of a silicon-containing material selected from the group consisting of SiC series materials, SiN series materials, and SiO series materials, a carbon material selected from the group consisting of amorphous carbon materials and diamond series carbon materials, or other material selected from the group consisting of BN series materials. The surface protective layer comprised of any of these materials is usually formed by means of the plasma CVD process. Specifically, U.S. Pat. No. 4,786,574 discloses electrophotographic photosensitive members having a surface protective layer comprised of a SiC series material. U.S. Pat. No. 4,965,154 discloses electrophotographic photosensitive members having a surface protective layer comprised of a SiN series material. U.S. Pat. No. 4,932,859 discloses electrophotographic photosensitive members having a surface protective layer comprised of an amorphous carbon material. Other than these, U.S. Pat. No. 5,153,086 and U.S. Pat. No. 5,183,719 disclose electrophotographic photosensitive members having a surface protective layer comprised of a metal oxide material. Further, U.S. Pat. No. 5,324,609 discloses electrophotographic photosensitive members having a surface protective layer comprised of an organic high molecular material.

By the way, in recent years, in order to improve the efficiency in the office works, there has been an increased demand for a further improvement in the rate of operation of the electrophotographic apparatus used, specifically, for a further prolongation of the lifetime of the electrophotographic photosensitive member used in the electrophotographic apparatus. The a-Si electrophotographic photosensitive member satisfies such demand since it has a sufficient surface hardness and semipermanently exhibits desirable electric characteristics and its life is inexhaustible in the ordinary use.

However, as for the electrophotographic apparatus provided with the a-Si electrophotographic photosensitive member, there is a disadvantages such that when electrophotographic image formation is continuously conducted over a long period of time, a film comprising a resin component of a developer is liable to form on the surface of the a-Si electrophotographic photosensitive member. In order to maintain the surface of the a-Si electrophotographic photosensitive member in a clean state, it is necessary to periodically conduct a maintenance work to remove such film formed on the surface of the a-Si electrophotographic photosensitive member by suspending the operation of the electrophotographic apparatus. Hence, the electrophotographic apparatus provided with the a-Si electrophotographic photosensitive member is not satisfactory in terms of the rate of operation.

In order to diminish the above maintenance work, there is considered a manner of improving the cleaning property of the developer at the surface of the a-Si electrophotographic photosensitive member. For this purpose, it will be effective to design the surface of the a-Si electrophotographic photosensitive member and the developer such that they can be well released one from the other, specifically such that the developer is hardly deposited on the surface of the a-Si electrophotographic member. In order to attain this situation, a manner in which the surface of the a-Si electrophotographic photosensitive member is designed to have an increased contact angle against water (that is, an increased water repellency in other words).

Herein, in general, the generally known a-Si photosensitive members are of a surface contact angle against water in the range of 20° to 100°. As for the a-Si photosensitive members which are practically usable as an electrophotographic photosensitive member in an electrophotographic apparatus, their surface contact angles against water are somewhat different one from the other depending upon their surface constituent materials. But they are mostly of a surface contact angle against water in the range of 50° to 70°. It is difficult for them to have a further increased water repellency.

Now, there are known fluororesins which impart a water repellency of providing a surface contact angle against water of near 180° for layers formed by them. The present inventors prepared a plurality of a-Si electrophotographic photosensitive members each having a surface protective layer formed of one of those fluororesins. And their surfaces were examined with respect to water repellency and adhesion with the layer situated under the surface protective layer. As a result, it was found that they are sufficient in terms of the water repellency (that is, their surface contact angles against water are of near 180°) but their surface protective layers are poor in adhesion. The present inventors conducted further examinations by repeatedly conducting electrophotographic image formation using a high speed copying machine provided with a blade cleaning means in which one of the a-Si electrophotographic photosensitive members was installed. As a result, it was found that any of the a-Si electrophotographic photosensitive members is liable to cause a removal between the surface protective layer and the layer situated thereunder and thus, any of the a-Si electrophotographic photosensitive members is not practically usable.

Separately, a so-called coating film comprising an inorganic material for a semiconductor device may be formed by means of a sputtering process other than the above described plasma CVD process. Other than these film-forming process, it may be formed by means of a manner in which a so-called sol-gel process is utilized.

In the case of forming a coating film using an inorganic material such as an amorphous material, e.g., glass, it is formed through an atmosphere maintained at a high temperature of higher than 1000° C. or by using an expensive specific VPE (vapor phase epitaxy) apparatus.

In the case of forming a coating film composed of an inorganic material such as a silicon-containing amorphous material as a surface protective layer on a light receiving layer of an electrophotographic photosensitive member, it is usually formed by means of such plasma CVD process as previously described or a sputtering process because of relatively low heat resistance of the light receiving layer. However, in this case, the light receiving layer on which the surface protective layer is formed is required to be sufficiently resistant to a temperature of 100° to 300° C. under a given vacuum atmospheric condition. In view of this, such coating film composed of an inorganic material such as a silicon-containing amorphous material is employed only in an a-Si electrophotographic photosensitive member or a certain OPC electrophotographic photosensitive member in which a highly heat resistant binder is used.

Now, the above described sol-gel process makes it possible to form a functional material at a remarkably low substrate temperature. U.S. Pat. No. 5,153,086 and U.S. Pat. No. 5,183,719 disclose photoelectric photosensitive members prepared using the sol-gel process. Particularly, these U.S. patent documents disclose a manner of obtaining a sol solution by dissolving an alkoxide compound or an acetylacetonate as an organic metal complex in an alcohol or a mixture comprising an alcohol and water and subjecting the resultant to hydrolysis, dispersing electrically conductive metal oxide fine powder in the sol solution to obtain a dispersion, applying the dispersion onto a substrate for an electrophotographic photosensitive member or a light receiving layer formed on a substrate by a spray coating or dip coating manner, and subjecting the resultant to heat treatment to remove the solvent, whereby a hard thin film as an under coat layer or a surface protective layer is formed.

For the gelled thin film thus formed as the surface protective layer, it is still insufficient in terms of the adhesion with the photosensitive layer and the surface releasing property (that is, the surface water repellency). In addition to this, there is a problem in that a film comprising a resin component of a developer is liable to deposit on the surface of the surface protective layer.

The present inventors prepared a plurality of a-Si electrophotographic photosensitive members each having a surface protective layer formed by means of the above solgel process. And their surfaces were examined with respect to surface releasing property (surface water repellency) and adhesion with the layer situated under the surface protective layer. As a result, it was found that they are insufficient in terms of not only the surface water repellency but also the adhesion. Using a high speed copying machine provided with a blade cleaning means in which one of the a-Si electrophotographic photosensitive members was installed, the present inventors conducted further examinations by repeatedly conducting electrophotographic image formation over a long period of time. As a result, it was found that a removal is liable to occur between the surface protective layer and the light receiving layer situated thereunder and a film comprising a resin component of a developer is liable to deposit on the surface of the a-Si electrophotographic photosensitive member.

The deposition of such resin component film on the surface of the electrophotographic photosensitive member leads to providing copied images accompanied by defects, wherein a high quality copied image cannot be stably provided. In addition to this, it sometimes prevents a developer on the surface of the electrophotographic photosensitive member from sufficiently transferring onto a recording sheet such as a paper in the transfer step of the image formation process. The residual developer remained on the surface of the electrophotographic photosensitive member is removed by means of a cleaner such as a cleaning blade in the cleaning step. However, in the case where the residual developer is excessively present on the surface of the electrophotographic photosensitive member, it is difficult to be completely removed in the cleaning step, resulting in promoting the deposition of the foregoing resin component film on the surface of the electrophotographic photosensitive member. In the case where the transference of a developer on the surface of the electrophotographic photosensitive member to a recording sheet is insufficient particularly at a halftone portion, there entails a problem in that a image reproduced is accompanied by an uneveness in terms of the image density. This situation is remarkable in the case of conducting image formation using a high speed copying machine in which an electrophotographic photosensitive member is operated at a high speed, wherein the foregoing resin component film is more liable to deposit on the surface of the electrophotographic photosensitive member to increase the probability of causing the above problems. Further, the reduction in the amount of the developer dedicated for reproduction of an image results in increasing the amount of the developer to be removed by means of the cleaner. This situation leads to reducing the utilization efficiency of the developer. This problem should be solved also in view of reducing the amount of wastes.

The foregoing maintenance work which is periodically conducted for removing the resin component film deposited on the surface of the electrophotographic photosensitive member not only reduces the rate of operation of the electrophotographic apparatus but also increases an occasion of accidentally damage the surface of the electrophotographic photosensitive member upon cleaning it. Such damage occurred at the surface of the electrophotographic photosensitive member entails a serious problem in terms of the reuse.

SUMMARY OF THE INVENTION

The present invention is aimed at providing an improved electrophotographic photosensitive member which is free of deposition of a film comprising a resin component of a developer on the surface thereof (this film deposition will be hereinafter referred to as surface filming for simplification purpose) which is found in the conventional electrophotographic photosensitive member, a process for the production of said electrophotographic photosensitive member, and an electrophotographic apparatus provided with said electrophotographic photosensitive member.

Another object of the present invention is to provide an improved electrophotographic photosensitive member which excels in halftone reproduction.

A further object of the present invention is to provide an improved electrophotographic photosensitive member which is free of occurrence of surface filming and provides an improvement in the utilization efficiency of a developer.

A further object of the present invention is to provide an improved electrophotographic photosensitive member which is free of occurrence of surface filming and capable of repeatedly reproducing a high quality image with no defect due to surface filming even in the case of conducting electrophotographic image formation by using a high speed copying machine.

A further object of the present invention is to provide an improved electrophotographic photosensitive member which diminishes the load of a maintenance work for cleaning the surface thereof and improves the utilization efficiency of a developer so that the amount of wastes is reduced.

A typical embodiment of the electrophotographic photosensitive member which attains the above objects comprises a substrate, a light receiving layer composed of a non-single crystal material containing silicon atoms as a matrix and having photoconductivity disposed on said substrate, and a specific surface protective layer disposed on said light receiving layer, said specific surface protective layer comprising a metal oxide film formed by adjusting the surface of said light receiving layer to have a contact angle against water (hereinafter referred to as water contact angle) of 80° or more, applying a sol liquid comprising an organic metal compound admixed with water, an alcohol and an acid onto the surface of the light receiving layer, and subjecting the resultant to heat treatment.

The present invention includes a process for the production of the above described electrophotographic photosensitive member.

A typical embodiment of the process comprises the steps of:

providing a product in process for an electrophotographic photosensitive member, comprising a substrate, a light receiving layer composed of a non-single crystal material containing silicon atoms as a matrix and having photoconductivity disposed on said substrate;

adjusting the surface of said light receiving layer of said product in process to have a contact angle against water (a water contact angle) of 80° or more, applying a sol liquid comprising an organic metal compound admixed with water, an alcohol and an acid onto the surface of the light receiving layer, and subjecting the resultant to heat treatment to form a metal oxide film as a surface protective layer on the surface of the light receiving layer whereby obtaining an electrophotographic photosensitive member.

The present invention makes it a further object to provide an electrophotographic apparatus provided with the above described electrophotographic photosensitive member.

A typical embodiment of the electrophotographic apparatus comprises (a) an electrophotographic photosensitive member comprising a substrate, a light receiving layer composed of a non-single crystal material containing silicon atoms as a matrix and having photoconductivity disposed on said substrate, and a specific surface protective layer disposed on said light receiving layer, (b) a charging means for charging the surface of said electrophotographic photosensitive member, (c) a light irradiating means for forming a latent image on the surface of said electrophotographic photosensitive member by way of light irradiation, (d) a developing means for visualizing said latent image with a developer, and (e) a cleaning means for removing the residual developer on the surface of said electrophotographic photosensitive member, characterized in that said surface protective layer of the electrophotographic photosensitive member comprises a metal oxide film formed by adjusting the surface of the light receiving layer of the electrophotographic photosensitive member to to have a contact angle against water (a water contact angle) of 80° or more, applying a sol liquid comprising an organic metal compound admixed with water, an alcohol and an acid onto the surface of the light receiving layer, and subjecting the resultant to heat treatment.

DESCRIPTION OF THE INVENTION AND THE PREFERRED EMBODIMENTS

Detailed description will be made of the present invention.

The present invention provides an electrophotographic photosensitive member having an improved surface protective layer which is free of deposition of a film comprising a resin component of a developer on the surface thereof (this film deposition will be hereinafter referred to as surface filming for simplification purpose), which is found in the conventional electrophotographic photosensitive member, and which enables to repeatedly reproduce a high quality image with no defect due to surface filming even in the case of conducting electrophotographic image formation by using a high speed copying machine. The electrophotographic photosensitive member diminishes the load of a maintenance work for cleaning the surface thereof and improves the utilization efficiency of a developer so that the amount of wastes is reduced.

The present invention includes a process for the production of said electrophotographic photosensitive member, and an electrophotographic apparatus provided with said electrophotographic photosensitive member.

The electrophotographic photosensitive member according to the present invention typically comprises a substrate, a light receiving layer composed of a non-single crystal material containing silicon atoms as a matrix and having photoconductivity disposed on said substrate, and a specific surface protective layer disposed on said light receiving layer, said specific surface protective layer comprising a metal oxide film formed by subjecting the surface of said light receiving layer to surface treatment so that the surface of the light receiving layer possesses a contact angle against water (a surface water contact angle) of 80° or more, applying a sol liquid comprising an organic metal compound admixed with water, an alcohol and an acid onto the treated surface of the light receiving layer, and subjecting the resultant to heat treatment.

In a preferred embodiment, the surface treatment for the surface of the light receiving layer is conducted using a plasma of a fluorine-containing gas.

In the following, description will be made of the electrophotographic photosensitive member according to the present invention.

Figure 1A:
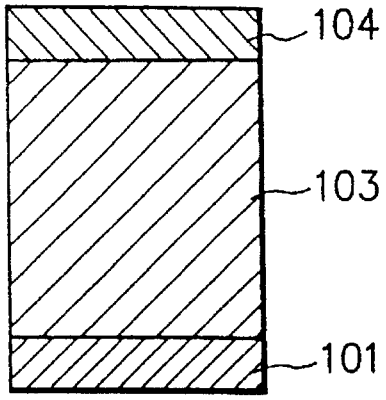
FIGS. 1(A) and 1(B) are schematic cross-sectional views each illustrating an example of the configuration of an electrophotographic photosensitive member according to the present invention.
Figure 1B:
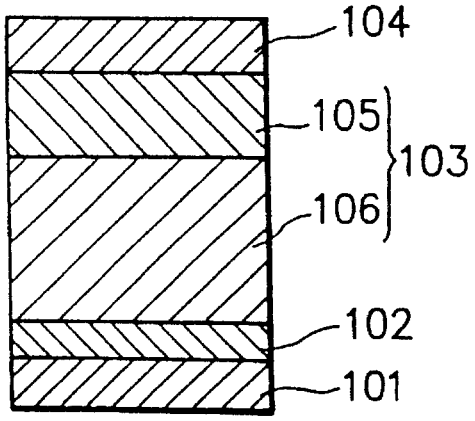

FIGS. 1(A) and 1(B) are schematic cross-sectional views respectively illustration a typical configuration of an electrophotographic photosensitive member according to the present invention. Shown in FIG. 1(A) is a single-layered type electrophotographic photosensitive member comprising a substrate 101, a light receiving layer 103 (or a photoconductive layer) comprising a single layer or of exhibiting a single function which is disposed on the substrate 101, and a surface protective layer 104 comprising the foregoing specific metal oxide film disposed on the photoconductive layer 103. Shown in FIG. 1(B) is a function division type electrophotographic photosensitive member which corresponds a modification of the electrophotographic photosensitive member shown in FIG. 1(A), wherein the light receiving layer 103 (the photoconductive layer) in FIG. 1(A) comprises a charge transportation layer 106 and a charge generation layer 105 disposed in the named order from the side of the substrate. Particularly, the electrophotographic photosensitive member shown in FIG. 1(B) comprises a substrate 101, a charge injection inhibition layer 102 disposed on the substrate 101, a two-layered photoconductive layer 103 comprising a charge transportation layer 106 and a charge generation layer 105 disposed on the charge injection inhibition layer, and a surface protective layer 104 comprising the foregoing specific metal oxide film disposed on the two-layered photoconductive layer 103.

The surface protective layer 104 composed of the specific metal oxide film in any of the electrophotographic photosensitive members shown in FIGS. 1(A) and 1(B) extremely excels in adhesion with the layer (the photoconductive layer 103) situated thereunder and excels in water repellency (that is, surface contact angle against water). Therefore, any of the electrophotographic photosensitive members shown in FIGS. 1(A) and 1(B) is suitable for use in a high speed copying machine, wherein repetitive reproduction of a high quality image over a long period of time is assured without causing deposition of a film originated from a developer (this film will be hereinafter occasionally called "developer film") on the surface of the electrophotographic photosensitive member. In any case, it is possible for the metal oxide film as the surface protective layer 104 to be incorporated with fluorine atoms. In this case, there is provided a pronounced advantage in that the metal oxide film has an improved surface contact angle against water (that is, an improved water repelleny in other words) so that a developer film can be more effectively prevented from depositing on the surface of the electrophotographic photosensitive member. This improves the suitability of the electrophotographic photosensitive member for use in a high speed copying machine.

Figure 2A:
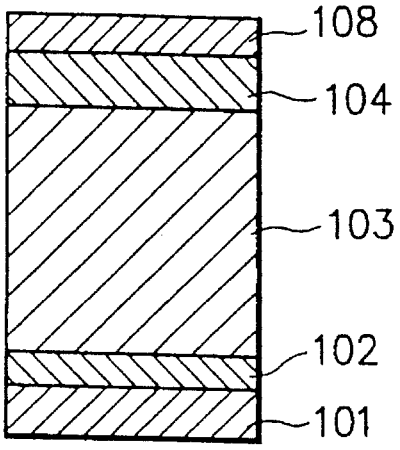
FIGS. 2(A) and 2(B) are schematic cross-sectional views each illustrating another example of the configuration of an electrophotographic photosensitive member according to the present invention.
Figure 2B:
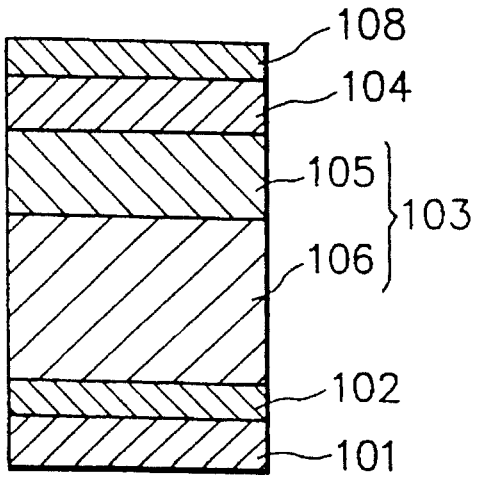

FIGS. 2(A) and 2(B) are schematic cross-sectional views respectively illustrating another configuration of an electrophotographic photosensitive member according to the present invention. Particularly, shown in FIG. 2(A) is a modification of the electrophotographic photosensitive member shown in FIG. 1(A), wherein in the configuration shown in FIG. 1(A), a fluorine-containing resin layer 108 is disposed on the metal oxide surface protective layer 104 and a charge injection inhibition layer 102 is disposed between the substrate 101 and the photoconductive layer 103. Shown in FIG. 2(B) is a modification of the electrophotographic photosensitive member shown in FIG. 1(B), wherein a fluorine-containing resin layer 108 is disposed on the metal oxide surface protective layer 104 of the configuration shown in FIG. 1(B).

In any of the electrophotographic photosensitive members shown in FIGS. 2(A) and 2(B), a further improved surface contact angle against water (that is, a further improved water repellency) is attained for the surface thereof, wherein a further improvement is provided in terms of the prevention of deposition of a developer film at the surface of the electrophotographic photosensitive member and accordingly, it is always assured to repeatedly reproduce an extremely high quality image over a long period of time even in the case where image formation is conducted in a high speed copying machine. As for the fluorine-containing layer, it may comprise, for example, chlorotrifluoroethylene which is a copolymer of fluoroethylene and vinyl monomer. It is most desirable for the fluorine-containing layer to comprise a cross-linked product of said chlorotrifluoroethylene, wherein the fluorine-containing layer exhibits a pronounced adhesion and can attain a tough coating excelling in adhesion with the metal oxide surface protective layer. As for the fluorine-containing layer, detailed description will be made later.

Figure 3A:
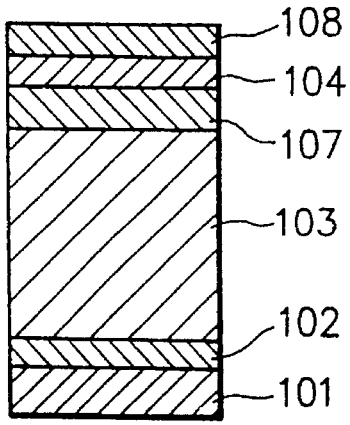
FIGS. 3(A) through 3(D) are schematic cross-sectional views each illustrating a further example of the configuration of an electrophotographic photosensitive member according to the present invention.
Figure 3B:
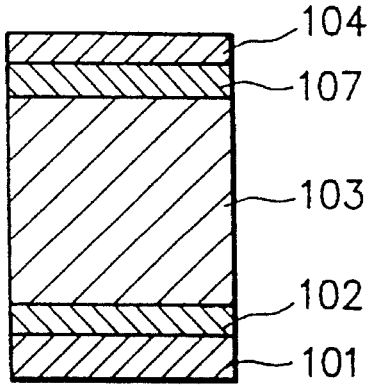
Figure 3C:
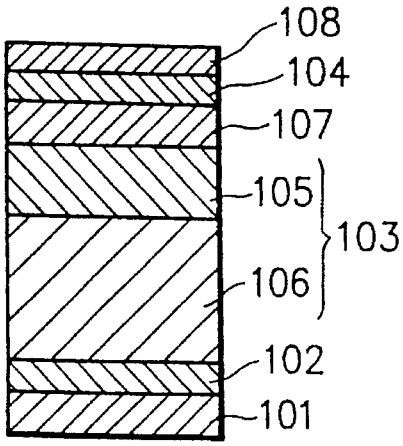
Figure 3D:
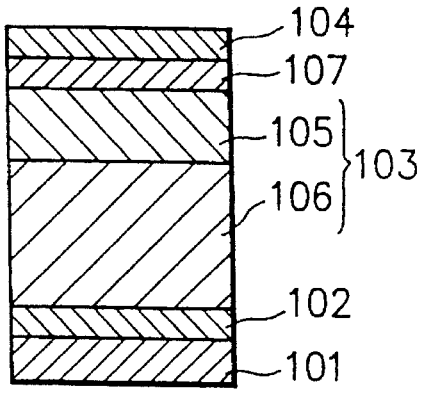

FIGS. 3(A), 3(B), 3(C) and 3(D) are schematic cross-sectional views illustrating a further configuration of an electrophotographic photosensitive member according to the present invention. Particularly, shown in FIG. 3(A) is a modification of the electrophotographic photosensitive member shown in FIG. 2(A), wherein in the configuration shown in FIG. 2(A), a so-called surface layer 107 is disposed between the photoconductive layer 103 and the metal oxide surface protective layer 104. Shown in FIG. 3(B) is a modification of the electrophotographic photosensitive member shown in FIG. 3(A), wherein the fluorine-containing resin layer 108 in the configuration shown in FIG. 3(A) is omitted. Shown in FIG. 3(C) is a modification of the electrophotographic photosensitive member shown in FIG. 2(B), wherein in the configuration shown in FIG. 2(B), a so-called surface layer 107 is disposed between the charge generation layer 105 and the metal oxide surface protective layer 104. Shown in FIG. 3(D) is a modification of the electrophotographic photosensitive member shown in FIG. 1(B), wherein in the configuration shown in FIG. 1(B), a so-called surface layer 107 is disposed between the charge generation layer 105 and the metal oxide surface protective layer 104.

In any of the electrophotographic photosensitive members shown in FIGS. 3(A) through 3(D), in addition to those advantages above described, the provision of the surface layer 107 provides an additional advantage in that an improvement is provided in terms of the charge retentivity and this entails an effect of raising the quality of an image reproduced in terms of the contrast and clearness.

The above described charge injection inhibition layer 102 is disposed for the purpose of preventing unnecessary charge from injecting from the substrate 101 into the photoconductive layer 103 (or the charge transportation layer 106). This charge injection inhibition layer serves to improve the electric characteristics including charge retentivity of the electrophotographic photosensitive member. However, the charge injection inhibition layer is not always necessary to be disposed and it is disposed if necessary.

In any of the above described embodiments having a light receiving layer comprising a charge injection inhibition layer or/and a surface layer in addition to a photoconductive layer (which optionally comprises a charge transportation layer and a charge generation layer), its light receiving layer may be be designed such that no distinct interface is established between the charge injection inhibition layer and the photoconductive layer or between the photoconductive layer and the surface layer, for example, by forming said light receiving layer such that the chemical composition thereof is gradually changed.

Now, description will be made of each constituent in the electrophotograhic photosensitive member according to the present invention.

Substrate 101

The substrate used in the present invention may either be electrically conductive or electrically insulative. The electrically conductive substrate can include, for example, metals such as Al, Cr, Mo, Au, In, Nb, Te, V, Ti, Pt, Pd, and Fe and alloys of these metals such as stainless steels. The electrically insulative substrate can include, for example, films or sheets of synthetic resins such as polyester, polyethylene, polycarbonate, cellulose acetate, polypropylene, polyvinyl chloride, polystyrene, and polyamide, glass, ceramics, and paper. Any of these films and sheets are desired to be applied with electroconductive treatment to at least one of the surfaces thereof on which a light receiving layer is to be formed. In this case, the remaining surface may be also applied with electroconductive treatment.

The substrate may be any configuration such as cylindrical, belt-like or plate-like shape, which can be properly determined depending upon the application uses.

The thickness of the substrate should be properly determined so that the electrophotographic photosensitive member can be formed as desired. In the case where flexibility is required for the electrophotographic photosensitive member, it can be made as thin as possible within a range capable of sufficiently providing the function as the substrate. However, the thickness is usually made to be greater than 10 μm in view of the fabrication and handling or mechanical strength of the substrate.

It is possible for the surface of the substrate to be uneven in order to prevent occurrence of defective images caused by a so-called interference fringe pattern being apt to appear In the images formed in the case where image formation is conducted using coherent monochromatic light such as laser beams. Particularly, in order to effectively prevent the occurrence of such defective image due To the interference fringe pattern. The surface of the substrate may be provided with irregularities comprising a plurality of spherical dimples whose sizes are smaller than the resolution required for The electrophotographic photosensitive member. The formation of such irregularities at the surface of The substrate may be conducted by the conventional method.

Photoconductive Layer 103

As above described, the photoconductive layer in the electrophotographic photosensitive member according to the present invention may be of a single layer configuration or a function division layer configuration. In the case of the function division layer configuration, it is desired to comprise a charge transportation layer 106 and a charge generation layer 105.

Single Layer Configuration

Description will be made of the case where The photoconductive layer 103 is of a single layer configuration (see, FIGS. 1(A), 2(A), 3(A) and 3(B)).

In the case where the photoconductive layer comprises a single layer comprised of a silicon-containing-material, it is formed so that it has a function of generating a charge in accordance with light impinged and a function of transporting said charge.

Typically, the single-layered photoconductive layer 103 (hereinafter simply referred to as photoconductive layer) is composed of a non-single crystal material containing silicon atoms (Si) as a matrix and at least hydrogen atoms (H) which exhibits photoconductive characteristics including a charge generating property and a charge transporting property.

Specifically, for example, the photoconductive layer is composed of a non-single silicon-containing material containing silicon atoms (Si) as a matrix and at least hydrogen atoms (H) preferably in an amount of 0.1 to 40 atomic % or more preferably in an amount of 1 to 40 atomic %. As a preferable example, there can be illustrated an a-Si:H material containing silicon atoms (Si) as a matrix and at least hydrogen atoms (H) preferably in an amount of 0.1 to 40 atomic % or more preferably in an amount of 1 to 40 atomic %.

If necessary, the photoconductive layer may contain atoms of a conductivity controlling element (hereinafter referred to as conductivity controlling atoms). In this case, the photoconductive layer may contain the conductivity controlling atoms in a state that they are uniformly distributed in the entire layer region thereof or in a state that they are unevenly distributed therein in the thickness direction. Alternatively, the photoconductive layer may have a partial layer region in which the conductivity controlling atoms are unevenly distributed in the thickness direction.

As the conductivity controlling element, so-called impurities in the field of the semiconductor can be mentioned, and those usable herein can include elements belonging to group III of the periodic table which provide a p-type conductivity (hereinafter simply referred to as group III element) and elements belonging to group v of the periodic table which provide an n-type conductivity (hereinafter simply referred to as group v element).

Specific examples of the group III element are B, Al, Ga, In, and Tl, of these elements, B, Al and Ga being the most preferable. Specific examples of the group V element are P, As, Sb, and Bi, of these elements, P and As being the most preferable.

The amount of the conductivity controlling atoms incorporated into the photoconductive layer is preferably in the range of from $1\times10^{-3}$ to $5\times10^{4}$ atomic ppm, more preferably in the range of from $1\times10^{-2}$ to $1\times10^{4}$ atomic ppm, or most preferably in the range of from $1\times10^{-1}$ to $5\times10^{3}$ atomic ppm.

Further, the photoconductive layer may contain atoms of an element selected from the group consisting of group Ia, IIa, VIa and VIII elements of the periodic table.

As for the thickness of the single-layered photoconductive layer, it should be properly determined having a due care so that the single-layered photoconductive layer can desirably function as a photoconductive layer in an electrophotographic photosensitive member to be obtained and also in economical viewpoints.

However, in general, it is preferably in the range of from 1 to 80 μm, more preferably in the range of from 5 to 60 μm, most preferably in the range of from 10 to 40 μm.

Function Division Layer Configuration

Description will be made of the case where the photoconductive layer 103 is of a function division layer configuration (see, FIGS. 1(B), 2(B), 3(C) and 3(D)).

In the case where the photoconductive layer has a function division layer configuration, it typically comprises a multilayered structure comprising a charge generation layer 105 having a function of generating a charge in accordance with light impinged, and a charge transportation layer 106 having a function of transporting said charge generated in the charge generation layer.

Description will be made of each of the charge generation layer and the charge transportation layer.

Charge Transportation Layer

The charge transportation layer is usually disposed on the side of the substrate.

The charge transportation layer is typically comprised of a non-single crystal material containing silicon atoms (Si), carbon atoms (C) and hydrogen atoms (H), and if necessary, fluorine atoms (F), specifically for example, an amorphous material containing silicon atoms (Si), carbon atoms (C) and hydrogen atoms (H), and if necessary, fluorine atoms (F) (that is, an a-SiC:(H,X) material), which exhibits photoconductive characteristics, particularly, charge retaining, charge generating and charge transporting characteristics. The carbon atoms (C) herein may be replaced by oxygen atoms (O) or nitrogen atoms (N). It is possible to contain two or more kinds of atoms selected from the group consisting of carbon atoms (C), oxygen atoms (0) and nitrogen atoms (N).

The amount of the carbon atoms (C) contained is preferably in the range of from 0.5 to 50 atomic %, more preferably in the range of from 1 to 40 atomic %, most preferably in the range of from 1 to 30 atomic %.

The amount of the hydrogen atoms (H) contained is preferably in the range of from 1 to 40 atomic %, more preferably in the range of from 5 to 35 atomic %, most preferably in the range of from 10 to 30 atomic %.

The amount of the fluorine atoms (F) contained is preferably in the range of from 1 to 95 atomic ppm, more preferably in the range of from 3 to 80 atomic ppm, most preferably in the range of from 5 to 50 atomic ppm.

In the case where the charge transportation layer additionally contains oxygen atoms (O) or/and nitrogen atoms (N), their amount is desired to be in the range of from 600 to 10,000 atomic ppm.

If necessary, the charge transportation layer may contain atoms of a conductivity controlling element.

As the conductivity controlling element, so-called impurities in the field of the semiconductor can be mentioned, and those usable herein can include elements belonging to group III of the periodic table which provide a p-type conductivity (hereinafter simply referred to as group III element) and elements belonging to group V of the periodic table which provide an n-type conductivity (hereinafter simply referred to as group v element).

Specific examples of the group III element are B, Al, Ga, In, and Tl, of these elements, B, Al and Ga being the most preferable. Specific examples of the group V element are P, As, Sb, and Bi, of these elements, P and As being the most preferable.

The amount of the atoms of a given conductivity controlling element incorporated into the charge transportation layer is preferably in the range of from $1\times10^{-3}$ to $5\times10^{4}$ atomic ppm, more preferably in the range of from $1\times10^{-2}$ to $1\times10^{4}$ atomic ppm, or most preferably in the range of from $1\times10^{-1}$ to $5\times10^{3}$ atomic ppm.

Further, the charge transportation layer may contain atoms of an element selected from the group consisting of group Ia, IIa, via and VIII elements of the periodic table.

As for the thickness of the charge transportation layer, it should be properly determined having a due care so that the charge transportation layer can desirably function as a charge transportation layer in an electrophotographic photosensitive member to be obtained and also in economical viewpoints.

However, in general, it is preferably in the range of from 5 to 50 μm, more preferably in the range of from 10 to 40 μm, most preferably in the range of from 20 to 30 μm.

Charge Generation Layer

The charge generation layer is usually disposed on the charge transportation layer disposed on the side of the substrate.

The charge generation layer is typically comprised of a non-single crystal material containing silicon atoms (Si) as a matrix and at least hydrogen atoms (H), specifically for example, an amorphous material containing silicon atoms (Si) as a matrix and at least hydrogen atoms (H) (that is, an a-Si:H material), which exhibits electrophotographic characteristics, particularly, charge generating characteristics.

Specifically, for example, the charge generation layer is composed of a non-single silicon-containing material containing silicon atoms (Si) as a matrix and at least hydrogen atoms (H) preferably in an amount of 0.1 to 40 atomic % or more preferably in an amount of 1 to 40 atomic %. As a preferable example, there can be mentioned an a-Si:H material containing silicon atoms (Si) as a matrix and at least hydrogen atoms (H) preferably in an amount of 0.1 to 40 atomic % or more preferably in an amount of 1 to 40 atomic %.

If necessary, the charge generation layer may contain atoms of a conductivity controlling element.

As the conductivity controlling element, so-called impurities in the field of the semiconductor can be mentioned, and those usable herein can include elements belonging to group III of the periodic table which provide a p-type conductivity (hereinafter simply referred to as group III element) and elements belonging to group V of the periodic table which provide an n-type conductivity (hereinafter simply referred to as group V element).

Specific examples of the group III element are B, Al, Ga, In, and Tl, of these elements, B, Al and Ga being the most preferable. Specific examples of the group v element are P, As, Sb, and Bi, of these elements, P and As being the most preferable.

The amount of the atoms of a given conductivity controlling element incorporated into the charge generation layer is preferably in the range of from $1\times10^{-3}$ to $5\times10^{4}$ atomic ppm, more preferably in the range of from $1\times10^{-2}$ to $1\times10^{4}$ atomic ppm, or most preferably in the range of from $1\times10^{-1}$ to $5\times10^{3}$ atomic ppm.

Further, the charge generation layer may contain atoms of an element selected from the group consisting of group Ia, IIa, VIa and VIII elements of the periodic table.

As for the thickness of the charge generation layer, it should be properly determined having a due care so that the charge generation layer can desirably function as a charge generation layer in an electrophotographic photosensitive member to be obtained and also in economical viewpoints.

However, in general, it is preferably in the range of from 0.1 to 15 μm, more preferably in the range of from 1 to 10 μm, most preferably in the range of from 1 to 5 μm.

Charge Injection Inhibition Layer 102

The charge injection inhibition layer in the electrophotographic photosensitive member according to the present invention is typically comprised of a non-single crystal material such as an amorphous silicon material, containing silicon atoms as a matrix and atoms of a conductivity controlling element belonging to group III or V of the periodic table (the atoms of a given conductivity controlling element will be hereinafter referred to as atoms (M)).

In order to improve the adhesion of the charge injection inhibition layer with the substrate, the charge injection inhibition layer may contain at least one kind of atoms selected from the group consisting of oxygen atoms, nitrogen atoms and carbon atoms (this atoms will be hereinafter referred to as atoms (O,N,C)).

The charge injection inhibition layer may contain either the atoms (M) or the atoms (O,N,C) in a uniformly distributed state or an unevenly distributed state in the thickness direction.

In the case where the atoms (M) are contained in an unevenly distributed state in the thickness direction, it is desired for them to be distributed such that their concentration is enhanced in a region adjacent to the substrate. By this, unnecessary charge is effectively prevented from injecting into the light receiving layer from the side of the substrate.

In the case where the atoms (O,N,C) are contained in an unevenly distributed state in the thickness direction, it is desired for them to be distributed such that their concentration is enhanced in a region adjacent to the substrate, or in a region adjacent to the layer situated above the charge injection inhibition layer, or in both said two regions. By this, the electrical characteristics of the charge injection inhibition layer can be prevented from being deteriorated, or the adhesion of the charge injection inhibition layer with the substrate can be improved.

As for the amount of the atoms (M) contained in the charge injection inhibition layer, it should be properly determined depending upon the performance and characteristics required for the charge injection inhibition layer. However, in general, it is preferably in the range of from $1\times10^{-3}$ to $5\times10^{4}$ atomic ppm, more preferably in the range of from $1\times10^{-2}$ to $1\times10^{4}$ atomic ppm, most preferably in the range of from $1\times10^{-}$to $5\times10^{3}$ atomic ppm. Similarly, the amount of the atoms (O,N,C) contained in the charge injection inhibition layer should be properly determined.

As for the thickness of the charge injection inhibition layer, it is preferably in the range of from 0.3 to 10 μm, more preferably in the range of from 0.5 to 5 μm, most preferably in the range of from 1 to 3 μm.

In any case, it is desired for the charge injection inhibition layer to contain hydrogen atoms. As for the amount of the hydrogen atoms contained in the charge injection inhibition layer, it is preferably in the range of from 0.1 to 40 atomic %, more preferably in the range of from 1 to 30 atomic %. The charge injection inhibition layer may contain halogen atoms, if necessary.

Surface Layer 107

The surface layer in the electrophotographic photosensitive member according to the present invention is typically comprised of a non-single crystal material such as an amorphous material, containing silicon atoms (Si), at least one kind of atoms selected from the group consisting of carbon atoms (C), nitrogen atoms (N), and oxygen atoms (0) (hereinafter referred to as atoms (C,N,O)), and in addition to these atoms, hydrogen atoms (H), and if necessary, halogen atoms (X).

The surface layer may contain the atoms (C,N,O) in a uniformly distributed state or an unevenly distributed state in the thickness direction.

In the case where the atoms (C,N,O) are contained in an unevenly distributed state in the thickness direction, it is possible for them to be distributed such that their concentration is enhanced in a give partial layer region. In any case, the atoms (C,N,O) are desired to contained such that they are uniformly distributed in the in-plane direction in parallel to the substrate.

As for the amount of the atoms (C,N,O) contained., it is preferably in the range of from 40 to 90 atomic %, more preferably in the range of from 45 to 85 atomic %, most preferably in the range of from 50 to 80 atomic %, in terms of a total amount. In the case where the carbon atoms (C), nitrogen atoms (N) and oxygen atoms (0) are together contained in the surface layer, the amount of each atoms is desired to be 10 atomic % or less.

In the case where the surface layer contains the halogen atoms (X), the amount Thereof is desired to be 20 atomic % or less. And in the case where the surface layer contains both the hydrogen atoms (H) and halogen atoms (X), the sum of the amounts for the hydrogen atoms and halogen atoms (H+X) is desired to be preferably in The range of from 30 to 70 atomic %, more preferably in the range of from 35 to 65 atomic %, most preferably in the range of from 40 to 60 atomic %.

If necessary, the surface layer may further contain atoms of an element selected from the group consisting of group Ia, IIa, VIa, and VIII elements of the periodic table.

As for the thickness of the surface layer, it should be properly determined having a due care so that the surface layer can desirably function as a surface layer in an electrophotographic photosensitive member to be obtained and also in economical viewpoints.

However, in general, it is preferably in the range of from 0.01 to 30 μm, more preferably in the range of from 0.05 to 20 μm, most preferably in the range of from 0.1 to 10 μm.

Each of the single-layered photoconductive layer, the multilayered photoconductive layer (comprising the charge generation layer and charge transportation layer), the charge injection inhibition layer, and the surface layer may be formed by a conventional vacuum deposition process, wherein the formation of each layer is conducted under predetermined film-forming conditions therefor.

The vacuum deposition process can include glow discharge decomposition processes (including alternate current glow discharge CVD process such as low frequency plasma CVD process, high frequency plasma CVD process, and microwave plasma CVD process, and direct current glow discharge CVD process), sputtering process, vacuum evaporation process, ion plating process, photo-induced CVD process, and thermal-induced CVD process. Of these film-forming processes, the high frequency plasma CVD process and microwave plasma CVD process are most appropriate.

Hence, each of the single-layered photoconductive layer, the multilayered photoconductive layer (comprising the charge generation layer and charge transportation layer), the charge injection inhibition layer, and the surface layer is desired to be formed by the high frequency plasma CVD process or microwave plasma CVD process.

Each layer may be effectively formed by any of these plasma CVD processes using an appropriate gaseous film-forming raw material. In the following, description will be made of some examples of forming any of the foregoing layers by these plasma CVD processes.

For example, in order to form a layer constituted by an a-Si:H material, a gaseous raw material capable supplying Si and a gaseous raw material capable of supplying H are introduced into a deposition chamber containing a substrate therein, wherein glow discharge is caused to thereby form said a-Si:H layer on the substrate. Such Si-supplying gaseous raw material can include gaseous or gasifiable silicon hydrides such as silanes. Specific examples are $SiH_4$, $Si_2H_6$, $Si_3H_8$, $Si_4H_{10}$, etc., of these, $SiH_4$ and $Si_2H_6$ being particularly preferred in view of the easy layer forming work and the good efficiency for the supply of Si.

As the H-supplying gaseous raw material, $H_2$ is usually used. Other than this, gaseous or gasifiable silicon hydrides such as $SiH_4$, $Si_2H_6$, $Si_3H_8$, and $Si_4H_{10}$ may be used as a H-supplying source. The use of these silicon hydrides is very advantageous since they can supply not only H but also Si.

In order to form a layer constituted by an a-SiC material, any of the foregoing Si-supplying raw material gases and a gaseous or gasifiable raw material capable of supplying C are introduced into the deposition chamber containing a substrate therein, wherein glow discharge is caused to thereby form said a-SiC layer on the substrate.

The C-supplying gaseous or gasifiable raw material can include saturated hydrocarbons having 1 to 5 carbon atoms such as $CH_4$, $C_2H_6$, $C_3H_8$, etc., ethylenic hydrocarbons having 2 to 5 carbon atoms such as $C_2H_4$, $C_3H_6$, etc., and acetylenic hydrocarbons having 2 to 3 carbon atoms such as $C_2H_2$, $C_3H_4$, etc.

In order to form a layer constituted by an amorphous silicon material containing oxygen atoms (O), any of the foregoing Si-supplying raw material gases and a gaseous or gasifiable raw material capable of supplying O are introduced into the deposition chamber containing a substrate therein, wherein glow discharge is caused to thereby form said layer on the substrate.

The gaseous or gasifiable O-supplying raw material can include $O_2$, NO, $NO_2$, etc. In the case of using NO or $NO_2$, it is possible introduce nitrogen atoms (N) into the layer in addition to the oxygen atoms (O). Other than these O-supplying raw materials, other appropriate gaseous 0r gasifiable compounds capable of supplying O such as CO, $CO_2$, etc. can be used as the O-supplying raw material. In the case of using CO or $CO_2$, it is possible to introduce carbon atoms (C) into the layer in addition to the oxygen atoms (O).

In order to form a layer constituted by an a-SiC:(H,F) material, any of the foregoing Si-supplying raw material gas, any of the foregoing H-supplying raw material gas, any of the foregoing C-supplying raw material gases, and a gaseous raw material capable supplying F are introduced into the deposition chamber containing a substrate therein, wherein glow discharge is caused to thereby form said a-SiC:(H,F) layer on the substrate.

The gaseous or gasifiable F-supplying raw material can include fluorine gas, fluorides, inter-halogen compounds containing fluorine such as BrF, ClF, $BrF_2$, $BrF_3$, etc., fluorine-substituted silane derivatives such as $SiF_4$, $Si_{2F6}$, etc.

In order to form a layer constituted by a silicon-containing amorphous material containing atoms of a conductivity element belonging to group III of the periodic table (the atoms will be hereinafter referred to as group III atoms) or atoms of a conductivity element belonging to group V of the periodic table (the atoms will be hereinafter referred to as group V atoms), any of the foregoing Si-supplying raw material gas and a gaseous or gasifiable raw material capable of supplying the group III atoms or group V atoms are introduced into the deposition chamber containing a substrate therein, wherein glow discharge is caused to thereby form said layer on the substrate.

The group III atom-supplying gaseous or gasifiable raw material can include boron hydrides such as $B_2H_6$, $B_4H_{10}$, $B_5H_9$, $B_5H_{11}$, $B_6H_{10}$, $B_6H_{12}$, and $B_6H_{14}$, and boron halides such as $BF_3$, $BCl_3$, and $BBr_3$. Other than these, $AlCl_3$, $GaCl_3$, $Ga(CH_3)_3$, $INCl_3$, and $TlCl_3$ may be also usable.

The group V atom-supplying gaseous or gasifiable raw material can include phosphorous hydrides such as $PH_3$ and $P_2H_4$, and phosphorous halides such as $PH_4I$, $PF_3$, and $PF_5$. Other than these, $AsH_3$, $AsF_3$, $AsCl_3$, and $AsBr_3$ may be also usable.

Any of the above described raw material gases can be used diluted with an appropriate gas such as $H_2$ gas, He gas, Ar gas or Ne gas if necessary, upon the introduction thereof into the deposition chamber.

In the following, description will be made of an example of a fabrication apparatus suitable for practicing the high frequency plasma CVD process or microwave plasma CVD process.

Figure 4:
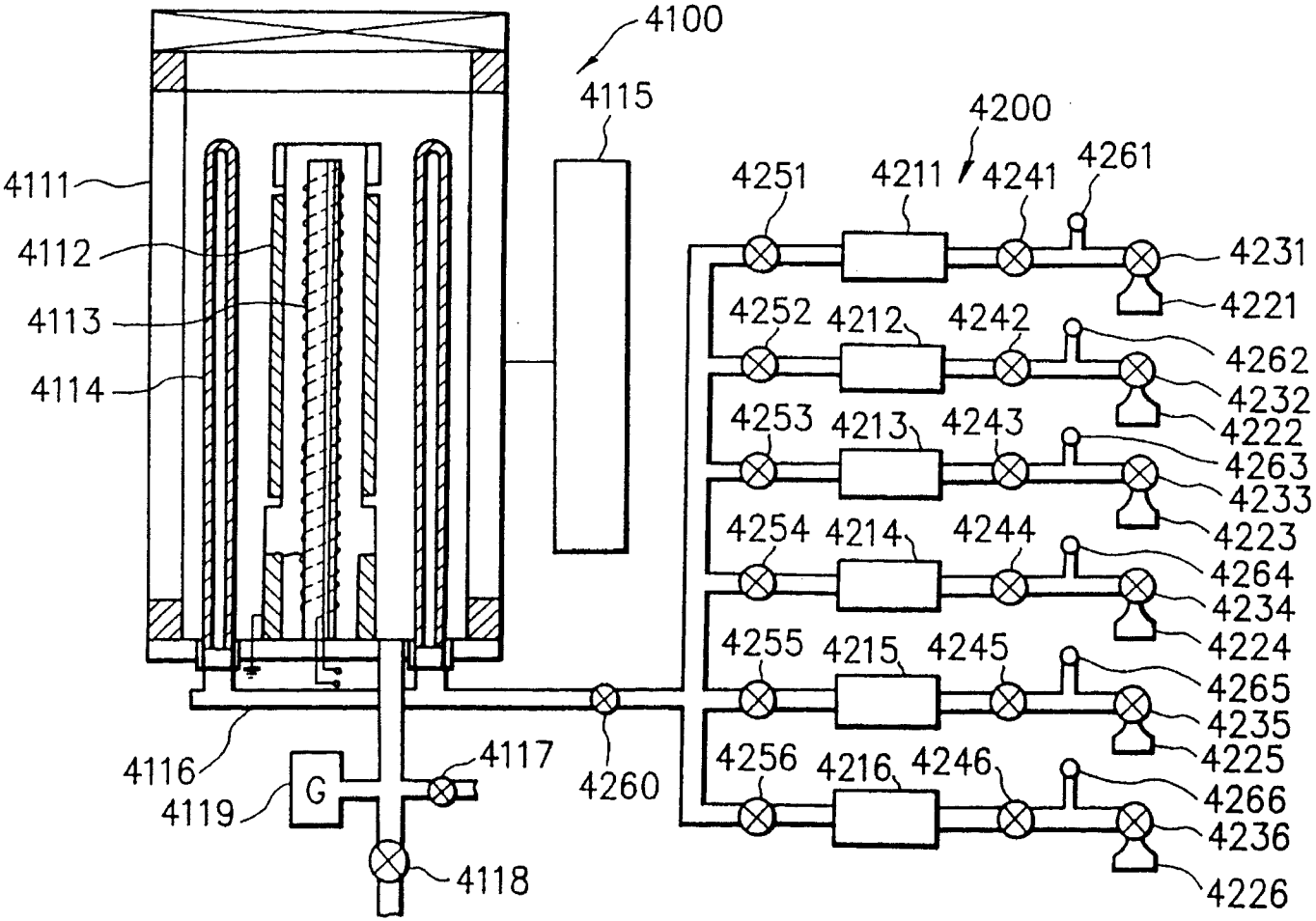
FIG. 4 is a schematic diagram illustrating a fabrication apparatus suitable for producing an electrophotographic photosensitive member by means of a high frequency (RF or VHF) plasma CVD process (this fabrication apparatus will be hereinafter referred to as high frequency plasma CVD apparatus) in the present invention.

FIG. 4 is a schematic diagram illustrating a fabrication apparatus suitable for producing an electrophotographic photosensitive member by means of the high frequency (RF or VHF) plasma CVD process (this fabrication apparatus will be hereinafter referred to as high frequency plasma CVD apparatus).

Figure 5:
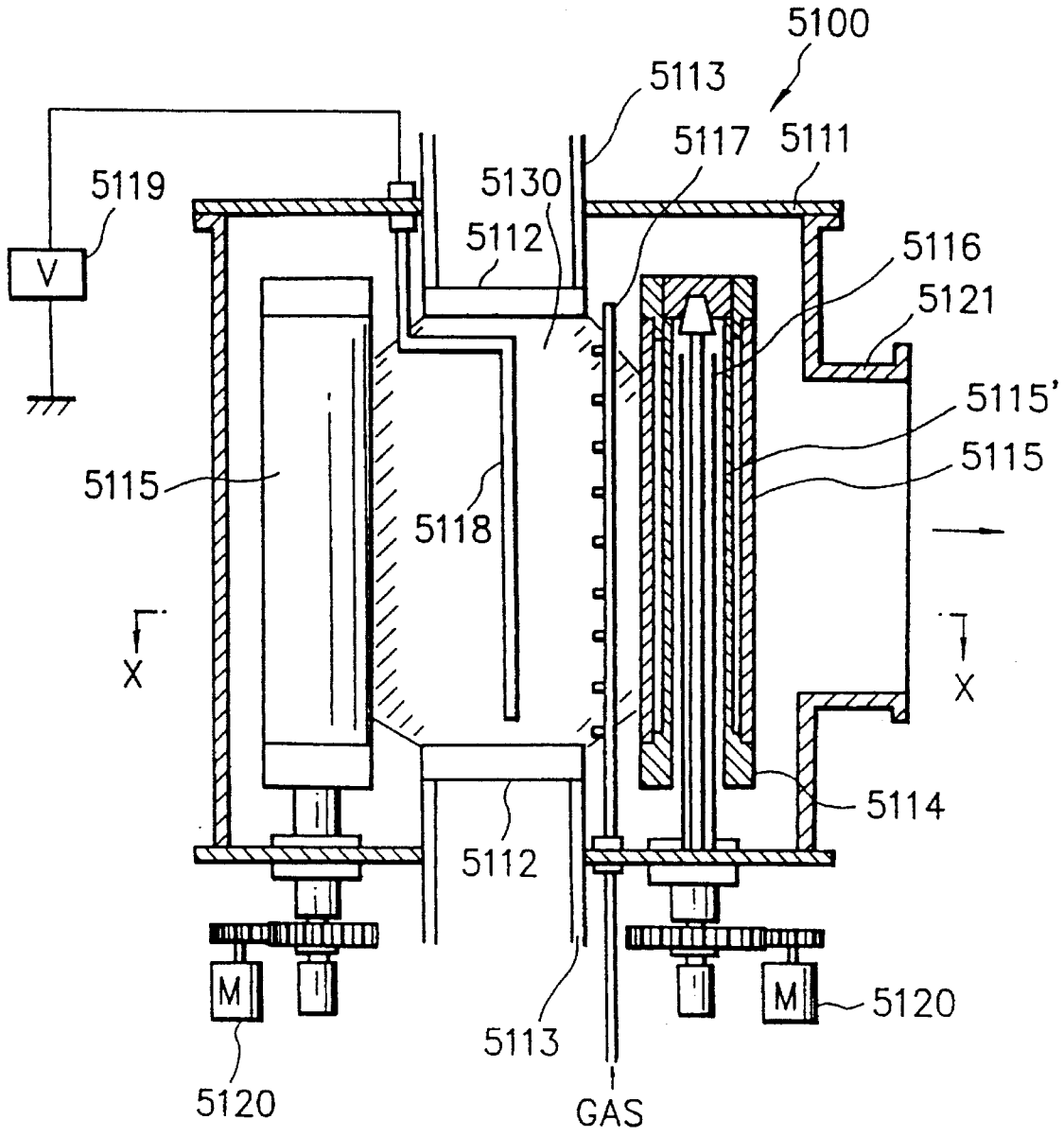
FIG. 5 is a schematic diagram illustrating another fabrication apparatus suitable for producing an electrophotographic photosensitive member by means of a microwave plasma CVD process (this fabrication apparatus will be hereinafter referred to as microwave plasma CVD apparatus) in the present invention.
Figure 6:
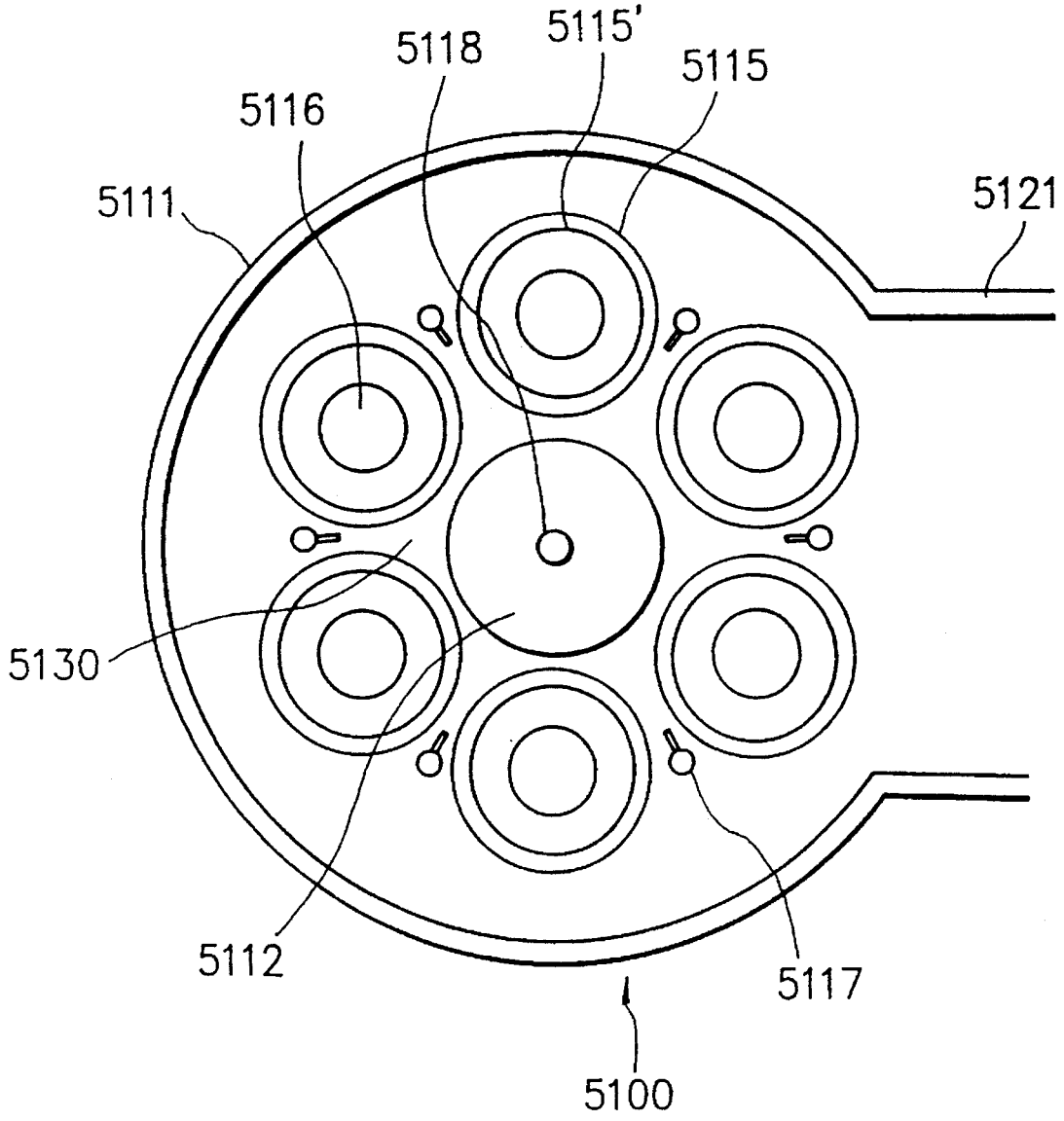
FIG. 6 is a schematic cross-sectional view, taken along the line X—X in FIG. 5.
Figure 7:
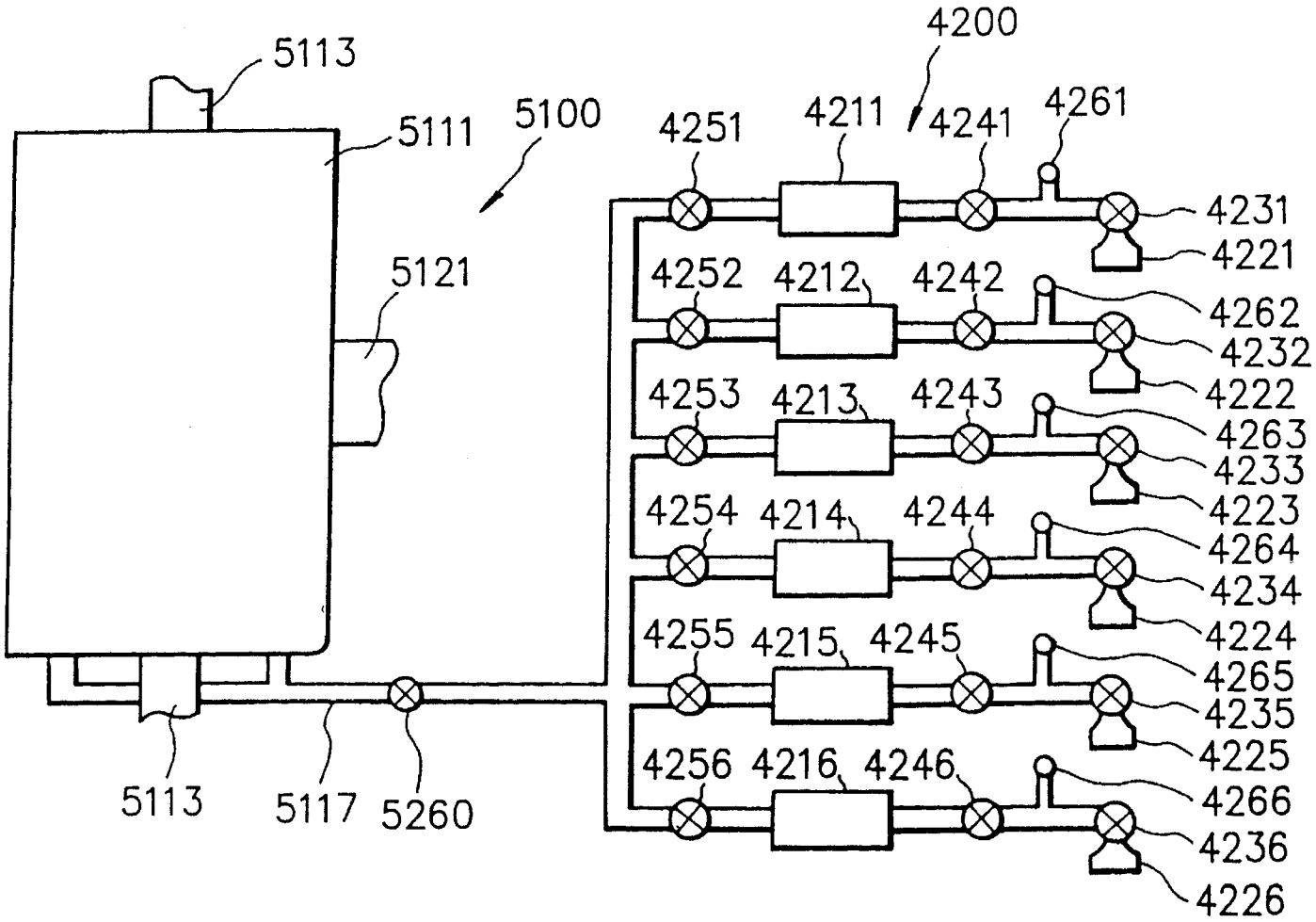
FIG. 7 is a schematic view illustrating a gas supply system connected to the microwave plasma CVD apparatus shown in FIGS. 5 and 6.

FIG. 5 is a schematic diagram illustrating a fabrication apparatus suitable for producing an electrophotographic photosensitive member by means of the microwave plasma CVD process (this fabrication apparatus will be hereinafter referred to as microwave plasma CVD apparatus). FIG. 6 is a schematic cross-sectional view, taken along the line X—X in FIG. 5. FIG. 7 is a schematic diagram illustrating a gas supply system connected to the microwave plasma CVD apparatus shown in FIGS. 5 and 6.

The high frequency plasma CVD apparatus shown in FIG. 4 comprises a deposition system 4100 having a deosition chamber 4111 capable of being vacuumed, a gas supply system 4200, and an exhaust system containing an exhaust pipe which is open into the reaction chamber 4111 and which is connected through a main valve 4118 to a vacuum pump (not shown).

The deposition chamber 4111 of the deposition system 4100 contains a substrate holder 4112 having an electric heater 4113 installed therein, and gas feed pipes 4114 for supplying a film-forming raw material gas into the deposition chamber. Reference numeral 4115 indicates a matching box electrically connected to the deposition chamber 4111. The matching box 4115 is electrically connected to a high frequency power source (not shown).

The gas supply system 4200 comprises gas reservoirs 4221 to 4226 respectively containing a raw material gas, for example, $SiH_4$, $H_2$, $CH_4$, NO, $NH_3$, or $SiF_4$, valves 4231 to 4236 for the gas reservoirs 4221 to 4226, inlet valves 4241 to 4246, exit valves 4251 to 4256, and mass flow controllers 4211 to 4216. Reference numerals 4261 to 4256 indicate each a pressure gauge. Reference numeral 4260 indicates a sub-valve disposed at a conduit extending from the gas supply system 4200 and which is communicated with each of the gas feed pipes 4114. Reference numeral 4117 indicates a leak valve. Reference numeral 4119 indicates a vacuum gauge.

Film formation in the high frequency plasma CVD apparatus shown in FIG. 4 is conducted, for example, in the following manner. That is, a cylindrical substrate is positioned on the substrate holder 4112 in the deposition chamber 4111. The inside of the deposition chamber 4111 is evacuated to a desired vacuum. The cylindrical substrate is heated to and maintained at a desired temperature. Given raw material gases from the gas reservoirs are introduced into the deposition chamber 4111 through the gas feed pipes 4114. In this case, each raw material gase from the corresponding gas reservoir is flown by gradually opening the corresponding inlet valve while adjusting its gas pressure to a desired value by means of the corresponding pressure gauge into the corresponding mass flow controller and then into the deposition chamber. After the gas pressure in the deposition chamber becomes stable at a desired value, the high frequency power source is switched on to apply a high frequency power (that is, RF or VHF) of a desired wattage into the deposition chamber through the matching box, wherein glow discharge is caused to decompose the raw material gases introduced therein whereby causing the formation of a layer comprising a deposited film on the cylindrical substrate. After the film formation, the application of the high frequency power and the introduction of the raw material gases are terminated.

A multilayered light receiving layer can be formed by repeating the above film-forming procedures.

The raw material gases in the gas reservoirs are selectively used depending upon the kind of a deposited film to be formed, wherein the valve operations are properly operated in accordance with the conditions for the formation of said deposited film.

The substrate temperature upon film formation is preferably in the range of from 20° to 500° C., more preferably in the range of from 50° to 480° C., most preferably in the range of from 100° to 450° C. As for the gas pressure in the deposition chamber upon film formation, it is preferably in the range of from $1\times10^{-5}$ to 10 Torr, more preferably in the range of from $5\times10^{-5}$ to 3 Torr, most preferably in the range of from $1\times10^{-4}$ to 1 Torr.

Description will be made of the microwave plasma CVD apparatus shown in FIGS. 5, 6 and 7.

In FIG. 5, reference numeral 5100 indicates a deposition system having a deposition chamber 5111 capable of being vacuumed. In FIG. 7, reference 4200 indicates a gas supply system connected to the deposition chamber 5111 shown in FIG. 5 through a pipe way. The gas supply system 4200 is the same as that in the high frequency plasma CVD apparatus shown in FIG. 4. Thus, description of the gas supply system 4200 is omitted.

The deposition chamber 5111 comprises a circumferential wall having an end portion thereof hermetically provided with a microwave introducing window 5112 to which a waveguide 5113 extending through a matching box and the like (not shown) from a microwave power source (not shown).

Reference numeral 5115 indicates a cylindrical substrate positioned on a rotatable cylindrical substrate holder 5115' having an electric heater 5116 capable of serving to adjust the temperature of said substrate. The substrate holder 5115' is supported by a rotary shaft connected to a driving mechanism including a driving motor 5120. Reference numeral 5130 indicates a discharge space (or a plasma generation space) which is circumscribed by a plurality of the cylindrical substrate holders 5115' being concentrically arranged in the deposition chamber 5111.

The deposition chamber 5111 is provided with a plurality of gas feed pipes 5117 each being arranged between each adjacent cylindrical substrate holders 5115' as shown in FIG. 6. Each gas feed pipe is provided with a plurality of gas liberation means capable feeding a raw material gas into the discharge space 5130. Each gas feed pipe is extended from the gas supply system 4200 (see, FIG. 7).

The deposition chamber 5111 is provided with an exhaust pipe 5121 which is connected to an exhaust system having a vacuuming means (not shown).

Reference numeral 5118 indicates a bias voltage applying means capable serving to control the potential of a plasma generated in the discharge space 5130. The bias voltage applying means 5118 is installed so as to extend into the discharge space 5130 as shown in FIG. 5. The bias voltage applying means 5118 is electrically connected to a DC power source 5119.

Film formation in the high frequency plasma CVD apparatus shown in FIG. 4 is conducted, for example, in the following manner. That is, a cylindrical substrate 5115 is positioned on each of the substrate holders 5115'. AlL the substrate holders are rotated and the inside of the deposition chamber is evacuated to a desired vacuum. Each of the cylindrical substrates is heated to and maintained at a desired temperature. Given raw material gases from the gas reservoirs are introduced into the depositio chamber 5111 through the gas feed pipes 5117. In this case, each raw material gase from the corresponding gas reservoir is flown by gradually opening the corresponding inlet valve while adjusting its gas pressure to a desired value by means of the corresponding pressure gauge into the corresponding mass flow controller and then into the deposition chamber. After the gas pressure in the deposition chamber becomes stable at a desired value, the microwave power source is switched on to apply a microwave power of a desired wattage into the discharge space of the deposition chamber through the microwave introducing window and concurrently, the DC power source is switched on to apply a desired bias voltage thereinto, wherein glow discharge is caused to decompose the raw material gases introduced into the discharge space whereby causing the formation of a layer comprising a deposited film on each of the cylindrical substrates. After the film formation, the application of the microwave power and the introduction of the raw material gases are terminated.

A multilayered light receiving layer can be formed by repeating the above film-forming procedures.

The raw material gases in the gas reservoirs are selectively used depending upon the kind of a deposited film to be formed, wherein the valve operations are properly operated in accordance with the conditions for the formation of said deposited film.

The substrate temperature upon film formation is preferably in the range of from 20° to 500° C., more preferably in the range of from 50° to 480° C., most preferably in the range of from 100° to 450° C. As for the gas pressure in the discharge space of the deposition chamber upon film formation, it is preferably in the range of from $1\times10^{-3}$ to $1\times10^{-1}$ Torr, more preferably in the range of from $3\times10^{-3}$ to $5\times10^{-2}$ Torr, most preferably in the range of from $5\times10^{-3}$ to $3\times10^{-2}$ Torr.

Surface Protective Layer 104

As previously described, the surface protective layer in the electrophotographic photosensitive member according to the present invention has a surface of exhibiting improved surface slip chacteristics so that a developer film is always effectively prevented from depositing on the surface of the electrophotographic photosensitive member during image formation even when it is repeatedly conducted in a high speed copying machine over a long period of time, wherein reproduction of a high quality image is assured.

The surface protective layer is comprised of an insulating metal-containing compound. The insulating metal-containing compound usable for the formation of the surface protective layer in the present invention can include organometallic compounds such as acetylacetonates and metal alkoxides.

Specific examples of such acetylacetonate are iron tris(acetylacetonate), cobalt bis(acetylacetonate), nickel bis(acetylacetonate), copper bis(acetylacetonate), and other acetylacetonates comprising these compounds containing a fluorine radical in their side chain represented by the general formula: $M(OR)_n$, with M being Such metal alkoxide can include, for example, those Na, Al, Ti, Mn, Fe, Co, Si, Zn, Zr, Y, or Eu, R being a carbon-containing group such as $C_nH_{2n-1}$ (with n being an integer of more than 1) and $C_6H_6$.

Specific examples of the metal alkoxide are Si-containing alkoxides such as tetramethyloxysilane ($Si(OCH_3)_4$), diphenyldimethyloxysilane ($(Ph)_2$-Si-(OMe)), diphenyldiethoxysilane ($(Ph)_2$-Si-(OEt)), 3-heptafluoroisopropoxy)propylmethyldichlorosilane ($C_7H_9C_{12}F_7OSi$), (tridekafluoro-1,1,2,2-tetrahydrooctyl)triethoxysilane ($C_{14}H_{19}F_{13}O_3Si$), $(C_6H_{13}F_3O_2Si)_n$, and (3,3,3-trifluoropropyl)methylcyclosiloxanes ($C_6H_{13}F_3O_2Si$), and with n being 3 or 4); Al-containing alkoxides such as $Al(OC_2H_5)_4$; Zn-containing alkoxides such as $Zn(OC_2H_5)_4$; and ti-containing alkoxides such as $Ti(OC_3H_7)_4$.

The formation of the surface protective layer using any of the foregoing acetylacetonates may be conducted, for example, by providing a sol dispersion comprising a mixture of the acetylacetonate, water, alcohol and hydrochloric acid, applying the sol dispersion onto the surface of a previously formed photoconductive layer by means of a conventional coating method such as a spray coating method or a dip coating method, removing the solvent of the coat formed on the object, followed by subjecting the coat to heat treatment to dry, whereby a dense metal oxide film as the surface protective layer is formed.

The formation of the surface protective layer using any of the foregoing metal alkoxides may be conducted, for example, by dissolving the metal alkoxide in an alcohol, subjecting the solution obtained to hydrolysis, applying the resultant onto the surface of a previously formed photoconductive layer by means of a conventional coating method such as a spray coating method or a dip coating method, removing the solvent of the coat formed on the object, followed by subjecting the coat to heat treatment to dry, whereby a dense metal oxide film as the surface protective layer is formed. In the case of using any of the foregoing metal alkoxides with a fluorine radical, the metal oxide film resulted is one which exhibits a higher water repellency because it contains fluorine therein.

As for the thickness of the surface protective layer, it should be properly determined within a thickness range capable of attaining a sufficient surface protective hardness for the surface thereof and of making the surface protective layer to effectively function as the surface protective layer, while having a due care so that no reduction is caused in the photosensitivity of the photoconductive layer due to unnecessary absorption of incident light by the surface protective layer and an increase is not caused in the residual potential because of the magnitude of the thickness of the surface protective layer.

In general, the thickness of the surface protective layer is desired to be preferably in the range of from 0.01 to 5 μm, more preferably in the range of from 0.1 to 3 μm, most preferably in the range of from 0.2 to 1 μm. However, these thickness ranges may be selectively employed depending upon the specification of an electrophotographic apparatus in which the electrophotographic photosensitive member used or the characteristics required for the electrophotographic photosensitive member. In any case, the surface protective layer composed of the specific metal oxide film is necessary to have a thickness of at least about 0.01 μm in view of forming the metal oxide film at a uniform thickness and also in view of making the surface protective layer to sufficiently exhibit its function to protect the light receiving layer. In order that the electrophotographic photosensitive member does not cause a fogged image due to an increase in the residual potential, the thickness of the surface protective layer is desired to be 5 μm or less. In order to attain a uniform thickness and desirable characteristics for the metal oxide film as the surface protective layer, its thickness is desired to be 0.1 μm or more. In view of preventing occurrence of a residual potential due to the lamination of the fluorine-containing resin layer on the surface protective layer, the surface protective layer is desired to be 3 μm or less. Further, in view of attaining a desirable productivity for the formation of the surface productive layer and also in view of shortening the drying time upon the formation of the surface protective layer, it is desired for the surface protective layer to be in the range of from 0.2 to 1 μm.

Upon the formation of the surface protective layer having a desired thickness in the foregoing range, a coating composition comprising the foregoing sol dispersion is applied in an amount to provide said thickness when dried. The thickness of the sol dispersion coat applied is remarkably reduced when the sol dispersion coat is dried. The magnitude of this thickness reduction is different depending upon the kind of the sol dispersion used and also the forming conditions including the application method employed. In general, the thickness of the surface protective layer finally resulted is 1/100 to 1/500 of that of the sol dispersion coat applied. In view of this, the thickness of the sol dispersion coat should be properly determined so that a desired thickness can be attained for the resulting surface protective layer. In general, it is made to be of a thickness of 100 to 500 times over that of the resulting surface protective layer.

The metal oxide film formed as the surface protective layer may be any metal oxide film as long as it can be used as the surface protective layer for an electrophotographic photosensitive member. However, in view of formation easiness, cost benefit, and the characteristics including light transmission characteristics required for the surface protective layer, it is desired to be formed of $SiO_2$, $Al_2O_3$, ZnO, $TiO_2$, $Fe_3O_4$, $Co_3O_4$, NiO, or CuO. In the case of using any of the foregoing metal alkoxides with a fluorine radical, there is provided a metal oxide film comprised of a $SiO_2$, $Al_2O_3$, ZnO, $TiO_2$, $Fe_3O_4$, $Co_3O_4$, NiO, or CuO material incorporated with fluorine atoms.

Fluorine-containing Resin layer 108

The fluorine-containing resin layer in the electrophotographic photosensitive member according to the present invention serves to attain a surface coating which excels in surface slip characteristics and excels in moisture resistance.

The fluorine-containing resin layer disposed on the metal oxide film as the surface protective layer attains a very tough adhesion between the surface protective layer and the fluorine-containing layer and a very smooth surface extremely excelling in surface slip characteristics for the electrophotographic photosensitive member so that there is no occasion for a developer film to be deposited on the surface of the electrophotographic photosensitive member during image formation even when it is repeatedly conducted in a high speed copying machine over a long period of time, wherein reproduction of a high quality image is always assured.

The fluorine-containing resin layer in the present invention is proncipally comprised of a fluorine-containing polymer resin (hereinafter referred to as fluororesin) comprising a copolymer of fluoroethylene and vinyl monomer.

The fluororesin constituting the fluorine-containing resin layer may be a cross-linked product of said copolymer with an appropriate organic peroxide as a crosslinking agent. In this case, there is attained a tough coating markedly excelling in adhesion with the metal oxide film as the surface protective layer.

In any case, when the above copolymer (which is not crosslinked) constituting the fluorine-containing resin layer is of 2 or more in acid value, the adhesion of the fluorine-containing resin layer with the surface protective layer is further improved, wherein no peeling is occurred at the electrophotographic photosensitive member even when repetitive cleaning by means of a cleaning blade is conducted at a high speed. And when the copolymer (which is not crosslinked) constituting the fluorine-containing resin layer is of 50 or less in hydroxyl value, there is attained a surface coating having a further improved moisture resistance for the electrophotographic photosensitive member.

Specific examples of the above copolymer are those copolymers comprising chlorotrifluoroethylene and vinyl monomer which have the following structural formula (I):

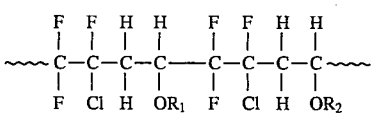

(I)

wherein $R_1$ and $R_2$ are each an alkyl group.

The vinyl monomer as the copolymerization monomer can include vinyl ether monomer and vinyl ester monomer.

The side chain group of the vinyl ether monomer can include methyl group, ethyl group, propyl group, n-butyl group, 2-butyl group, t-butyl group, n-hexyl group, and cyclohexyl group. Similarly, the side chain group of the vinyl ester monomer can include those alkyl groups mentioned in the case of the side chain group of the vinyl ester monomer.

As above described, the foregoing fluorine-containing polymer resin (the flororesin) constituting the fluorine-containing resin layer may be a crosslinked product obtained by subjecting the fluororesin to crosslinking treatment with the use of an appropriate cossslinking agent such as organic peroxide. The crosslinked fluororesin has a chemical structure represented by the following formula

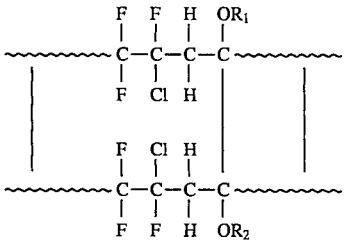

(II)

wherein $R_1$ and $R_2$ are each an alkyl group.

The organic peroxide as the crosslinking agent usable in the present invention can include hydroperoxide, dialkyl (diallyl) peroxide, diacyl peroxide, peroxyketal, peroxyester, peroxycarbonate, and ketone peroxide.

Specific examples of the hydroperoxide are t-butyl hydroperoxide, 1,1,3,3-tetramethylbutyl hydroperoxide, p-menthane hydroperoxide, cumene hydroperoxide, p-cumene hydroperoxide, diispropylbenzene hydroperoxide, 2,5-dimethylhexane- 2,5-dihydroperoxide, cyclohexane hydroperoxide, and 3,3,5-trimethylhexanone hydroperoxide.

Specific examples of the dialkyl (diallyl) peroxide are di-t-butyl peroxide, dicumyl peroxide, and t-butylcumyl-α-peroxide.

Specific examples of the diacyl peroxide are diacetyl peroxide, dipropyonyl peroxide, diisobutyryl peroxide, dioctanoyl peroxide, didecanoyl peroxide, dilauroyl peroxide, and peroxysuccinic acid.

Specific examples of the peroxyketal are 2,2-di-t-butylperoxide, 1,1-di-t-butylperoxycyclohexane, and 1,1-di-(t-butylperoxy)- 3,3,5-trimethylcyclohexane.

Specific examples of the peroxyester are t-butylperoxy acetate, t-butylperoxyisobutylate, t-butylperoxypivalate, and t-butylperoxyneodecanoate.

Specific examples of the peroxycarbonate are t-butylperoxyisopropylcarbonate, di-n-propylperoxydicarbonate, and di-sec-butylperoxydicarbonate.

Specific examples of the ketone peroxide are acetylacetone peroxide, methyl ethyl ketone peroxide, and methylisobutyl ketone peroxide.

The amount of the above organic peroxide as the crosslinking agent to added to the foregoing fluorine-containing polymer resin (the fluororesin) as the constituent of the fluorine-containing resin layer is desired to be preferably in the range of from 0.5 wt. % to 5 wt. %, more preferably in the range of from 1 wt. % to 3 wt. %, or most preferably in the range of from 1 wt. % to 2 wt. %, versus the Mount of the fluorine-containing polymer resin. In the case where the amount of the organic peroxide added is less than 0.5 wt. %, the fluorine-containing polymer resin is not sufficiently crosslinked. In this case, there is a fear for the fluorine-containing resin layer to be liable to deform due to heat applied, wherein the fluorine-containing resin layer is difficult to be maintained in a desired form. On the other hand, in the case where the amount of the organic peroxide added exceeds 5 wt. %, the resulting crosslinked product is liable to contain a certain amount of the organic peroxide and/or a certain amount of decomposed products of the organic peroxide, resulting in making the fluorine-containing resin layer to be insufficient in terms of the durability.

The fluorine-containing polymer resin (the fluororesin) to constitute the fluorine-containing resin layer may contain an acid component. In this case, a further improvement is provided in the adhesion of the fluorine-containing resin layer with the metal oxide surface protective layer. The incorporation of such acid component into the fluorine-containing polymer resin may be conducted by a manner of copolymerizing the foregoing copolymer with a third component comprising an appropriate acid substance or a manner of using a separate acid-containing resin or oligomer. In the former manner, when the fluorine-containing polymer resin (comprising the foregoing copolymer) does not have a hydroxyl group in the side chain thereof, there can be used (metha)acrylic acid, maleic acid, fumaric acid, or oleic acid as the substance. And when the fluorine-containing polymer resin (comprising the foregoing copolymer) has a hydroxyl group in the side chain thereof, said acids form an acetal group with the hydroxyl group, and because of this, it is desired to use such acid but an appropriate dibasic acid anhydride capable of introducing an acid component into the copolymer without causing the formation of such acetal group. Specific examples of such dibasic acid anhydride are oxalic anhydride, malonic anhydride, succinic anhydride, glutalic anhydride, and adipic anhydride.

As the acid-containing resin in the latter manner, there can be used styrene-maleic anhydride copolymer, or (metha)acrylic acid-copolymerized resins.

Now, when the fluorine-containing polymer resin to constitute the fluorine-containing resin layer comprises a crosslinked fluorine-containing polymer resin obtained from a non-crossliked fluorine-containing polymer resin having a hydroxyl value of exceeding 50, there is a tendency in that the hydroscopicity thereof is increased because the number of urethane bonds is increased, wherein the fluorine-containing resin layer is not sufficient in terms of the moisture resistance, resulting in causing a smeared image in image formation.

The acid value in the above means a value of an amount of potassium hydroxide in terms of mg which is required to neutralize acid contained in 1 g of a specimen. The acid value can be obtained by a manner of dissolving a fluorine-containing polymer resin specimen in a solvent composed of benzene and ethanol or a solvent composed of ether and ethanol to obtain a solution, subjecting the solution to titration using potassium hydroxide having a predetermined activity, and observing the amount of the potassium hydroxide used to neutralize the specimen.

The hydroxyl value in the above means a value of an amount of potassium hydroxide in terms of mg which is required to neutralize acetic acid bonded to an acetylated product obtained from 1 g of a specimen. The hydroxyl value can be obtained by a manner of heating a fluorine-containing polymer resin specimen together with acetic anhydride as an acetylating agent to acetylate the specimen thereby obtaining an acetylated product, measuring a saponification value of the acetylated product, and subjecting the measured result to calculation using the equation: hydroxyl value=A/(1–0.00075A)–B, with A being a saponification value after the acetylation, and B being a saponification value before the acetylation.

The foregoing polymer (that is, the fluorine-containing polymer resin) to constitute the fluorine-containing resin layer is desired to be of 50,000 to 300,000 in molecular weight. In the case where the molecular weight is less than 50,000, the resin is brittle. On the other hand, in the case where the molecular weight is beyond 300,000, the resin is poor in productivity.

The foregoing fluorine-containing polymer resin (the fluororesin) to constitute the fluorine-containing resin layer may be further incorporated with an appropriate silane coupling agent. In this case, the adhesion of the fluorine-containing resin layer with the surface protective layer is markedly improved. Specific examples of such silane coupling agent are vinyltrichlorosilane, vinyltris(β-methoxy)silane, vinyltrimethoxysilane, and vinyltriethoxysilane.

The formation of the fluorine-containing resin layer may be conducted by applying any of the foregoing fluorine-containing polymer resins onto the surface of the surface protective layer by means of a conventional coating method such as a spray coating method, or a dip coating method, and subjecting the resultant to drying treatment.

The thickness of the fluorine-containing layer should be properly determined depending upon the thickness of each of other constituent layers and while having a dure care so that the resulting electrophotographic photosensitive member exhibits excellent electrophotographic characteristics as desired. However, in general, it is preferably in the range of from 0.01 to 5 μm, more preferably in the range of from 0.1 to 3 μm, or most preferably in the range of from 0.2 to 1 μm.

In the case where the thickness is less than 0.01 μm, the formation of a fluorine-containing resin layer in a desirable state is difficult to be attained. In the case where the thickness exceeds 5 μm, there is a tendency that the resulting electrophotographic photosensitive member becomes such that provides a smeared image. In order to attain the formation of a desirable fluorine-containing resin layer having a uniform thickness, the thickness is desired to be 0.1 μm or more. And in order make the resulting electrophotographic photosensitive member to be free of occurrence of a smeared image, the thickness is desired to be 3 μm or less. Considering the productivity, cost benefit, and the period of time required for the layer formation, the thickness is desired to be in the range of from 0.2 to 1 μm.

In the following, description will be made of a manner of forming the surface protective layer and the fluorine-containing resin layer in the present invention.

As above described, the formation of each of the surface protective layer (comprising the foregoing metal oxide film) and the fluorine-containing resin layer may be conducted by a spray coating method or a dip coating method.

Figure 8:
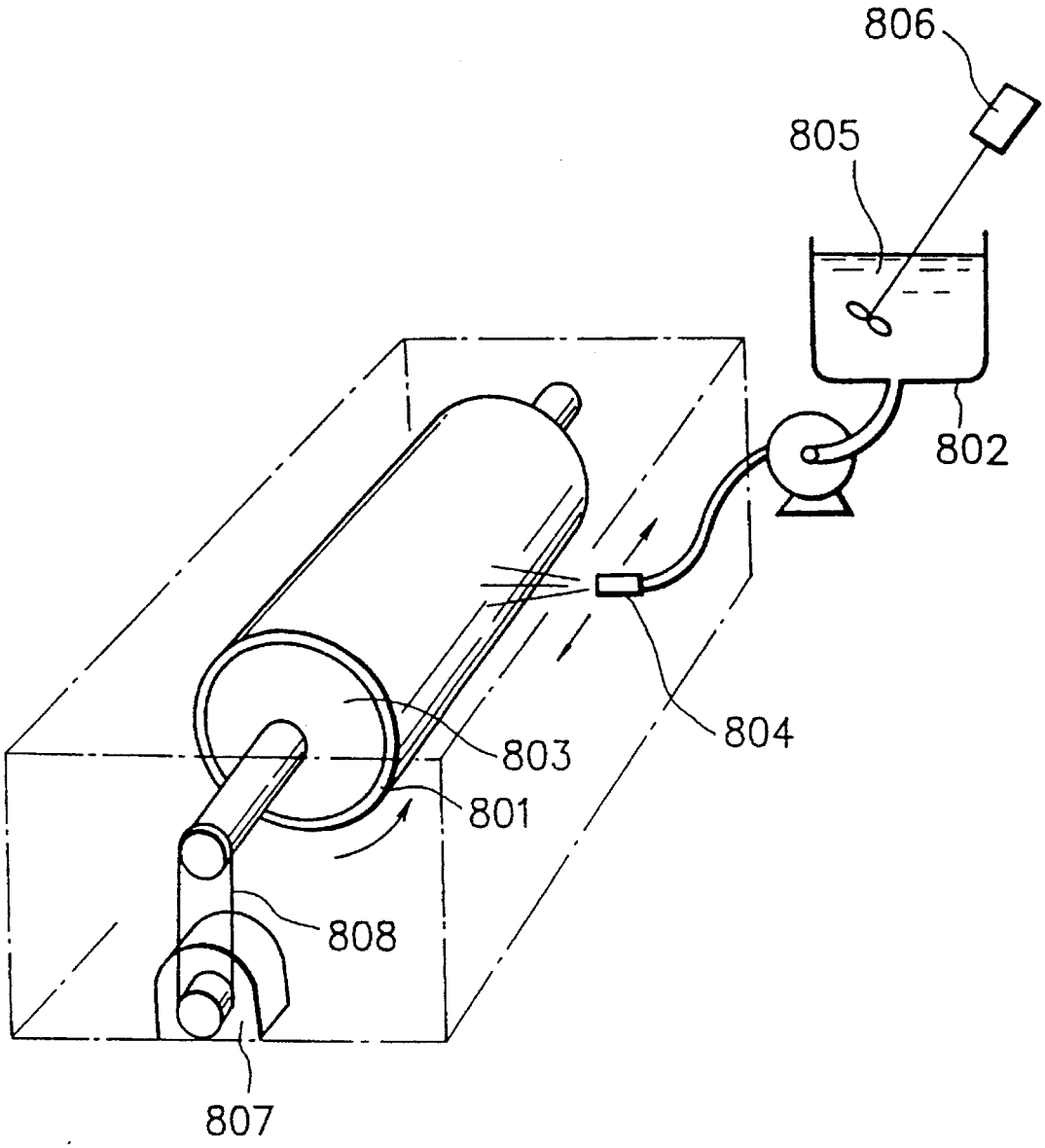
FIG. 8 is a schematic diagram of a spray coating device suitable for applying a coating composition onto the surface of a light receiving layer by means of a spray coating process in the present invention.

The spray coating method can be conducted by using an appropriate spray coating device. FIG. 8 is a schematic diagram of illustrating an example of such spray coating device.

In FIG. 8, reference numeral 801 indicates a cylindrical electrophotographic photosensitive member having nether a surface protective layer nor a fluorine-containing resin layer which is held on a rotary shaft connected to a motor 807 through a belt chain 808, reference numeral 802 a container containing a coating composition 805 for the formation of a metal oxide film as the surface protective layer or a fluorine-containing polymer resin film as the fluorine-containing resin layer therein, reference numeral 803 a fixing flange for the cylindrical electrophotographic photosensitive member 801, reference numeral 804 a spray nozzle, reference numeral 806 a motor for operating an agitator disposed in the coating composition container 802.

The spray nozzle 804 is designed such that it faces the surface of the electrophotographic photosensitive member 801 and that it can reciprocatively move along the surface of the electrophotographic photosensitive member.

It is possible for the motor 807 to be directly connected to the rotary shaft.

As apparent from FIG. 8, the coating composition 805 in the container 802 is stirred by the agitator connected to the motor 806. The coating composition 805 is ejected toward the surface of the cylindrical electrophotographic photosensitive member 801 which is rotating through the spray nozzle 804. By this, a coat comprising the coating composition is formed on the surface of the cylindrical electrophotographic photosensitive member 801.

Figure 9:
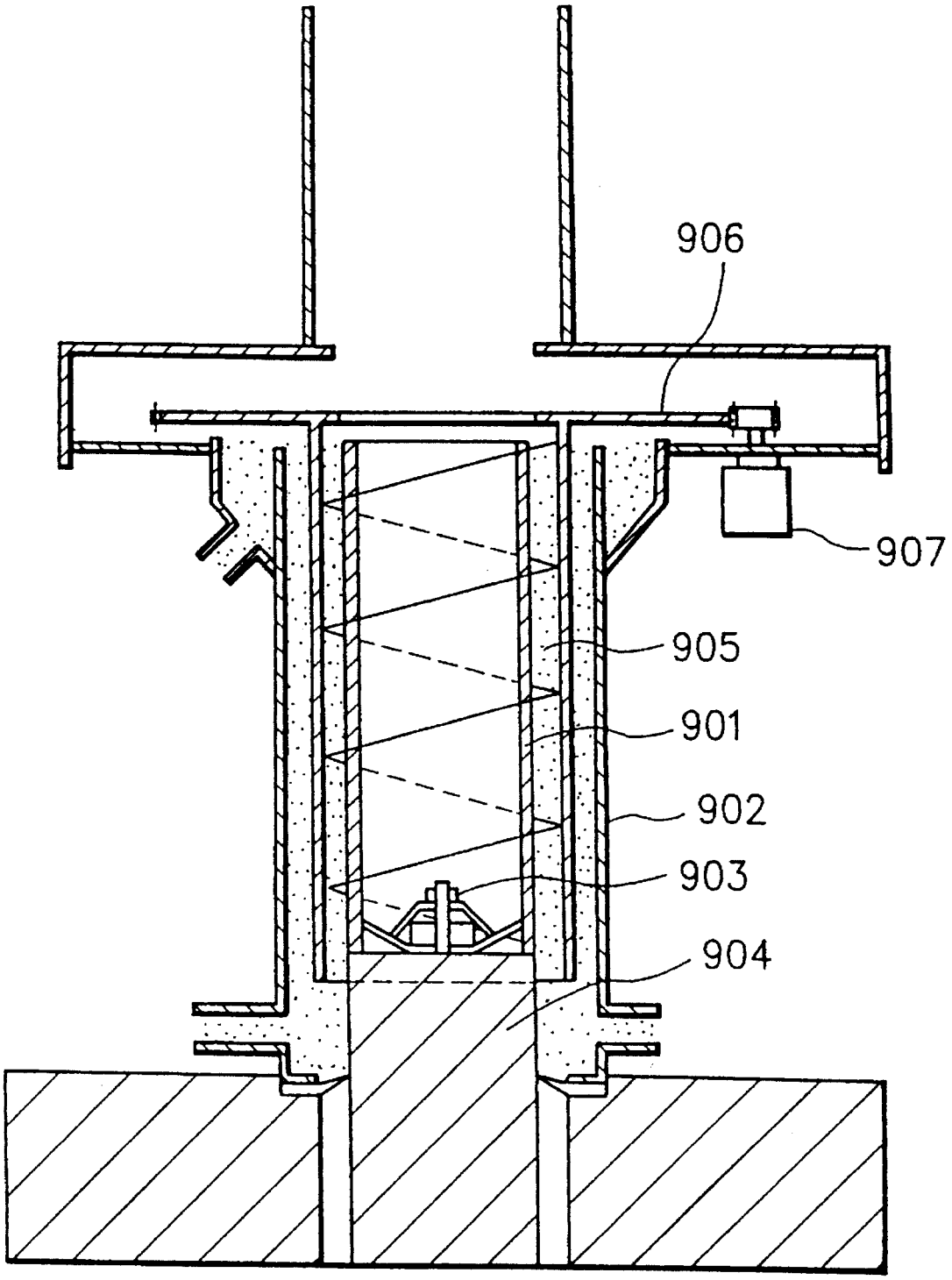
FIG. 9 is a schematic diagram of a dip coating device suitable for applying a coating composition onto the surface of a light receiving layer by means of a dip coating process in the present invention.

The dip coating method can be conducted by using an appropriate dip coating device. FIG. 9 is a schematic diagram of illustrating an example of such dip coating device.

In FIG. 9, reference numeral 901 indicates a cylindrical electrophotographic photosensitive member having nether a surface protective layer nor a fluorine-containing resin layer, reference numeral 902 a container in which a coating composition 905 for the formation of a metal oxide film as the surface protective layer or a fluorine-containing polymer resin film as the fluorine-containing resin layer is contained, reference numeral 903 a fixing means for the cylindrical electrophotographic photosensitive member 901, reference numeral 904 a holder for the cylindrical electrophotographic photosensitive member which can move up and down, and reference numeral 906 an agitating means which is connected to a driving motor 907.

The coating composition 905 in the container 902 is stirred by means of the agitating means which is operated by the driving motor 907. The electrophotographic photosensitive member 901 is fixed on the holder 904 by means of the fixing means 903 and it is moved down and dipped is first dipped in the coating composition 905 in the container 902 and it is then gradually lifted at a desired lifting speed, for example, at a lifting speed of 10 mm/minute to 1000 mm/minute. By this, a coat comprising the coating composition is formed on the surface of the cylindrical electrophotographic photosensitive member 901.

Other than these coating manners, there can be employed other coating manner as long as it can form a coat having a uniform thickness on the surface of the electrophotographic photosensitive member.

Now, in the case of forming the metal oxide film as the surface protective layer by and of the above described coating manners, the surface of the photoconductive layer or the surface layer of an electrophotographic photosensitive member on which the metal oxide film is to be formed is subjected to surface treatment with a plasma prior to forming the metal oxide film. The plasma surface treatment in this case may be conducted in a vacuum chamber (which can be the film-forming chamber) in which said electrophotographic photosensitive member is placed, wherein a fluorine-containing raw material gas is decomposed with the application of of a high frequency power or a microwave power to produce a plasma and the surface of the electrophotographic photosensitive member is reared with the plasma.

As the fluorine-containing raw material gas, it is desired to use an appropriate fluorine-containing raw material gas which can produce such a plasma that is capable of gradually etch the surface of the electrophotographic photosensitive member while remaining fluorine atoms on said surface. Such fluorine-containing raw material gas can include gaseous or easily gasifiable carbon fluorides and derivatives of them. Specific examples are $CCl_3F$, $CCl_2F_2$, $CBrClF_2$, $CClF_3$, $CBrF_3$, $CF_4$, $CHClF_2$, $CHF_3$, $C_2Cl_4F_2$, $C_2Cl_3F_3$, $C_2Cl_2F^4$, $C_2ClF_5$, $C_2F_6$, $C_2H_3ClF_2$, $C_2H_4F_2$, and $C_3F_8$.

These fluorine-containing raw material gases may be mixed with an inert gas or hydrogen gas in the surface plasma treatment. Specific examples of such inert gas are Ar gas, He gas, and nitrogen gas. In a preferred embodiment, there is used $CClF_3$, $CF_4$, $CHF_3$, $C_2F_6$, or $C_3F_8$ since these compounds having a high purity are commercially available. Among these, $CF_4$ and $C_2F_6$ are the most desirable. In any case, these compounds may be mixed with Ar gas, He gas or hydrogen gas in the surface plasma treatment.

Description will be made of an example of the above surface plasma treatment. An electrophotographic photosensitive member to be subjected to the surface plasma treatment is placed in a vacuum chamber and it is heated to and maintained at a desired temperature of room temperature (20° C.) to 200° C. Then, an appropriate fluorine-containing raw material gas (for example, $CF_4$ gas) is introduced into the vacuum chamber at a desired flow rate, for example, of 50 to 1000 sccm. In this case, the fluorine-containing raw material gas may be diluted with Ar gas, He gas or hydrogen gas in order to stabilize glow discharge cause in the vacuum chamber. The gas pressure in the vacuum chamber is controlled to and maintained at a desired vacuum, for example, of 0.1 to 1.0 Torr. Then, a high frequency power (13.56 MHz) of 100 to 2000 W is applied into the vacuum chamber to cause glow discharge thereby producing a plasma, wherein the surface of the electrophotographic photosensitive member is treated with the plasma. This surface plasma treatment is conducted for a desired period of time, for example, for 5 to 120 minutes.

As for the above gas pressure in the vacuum chamber and the high frequency power applied, they are desired to be properly adjusted in order to shorten the period of time for the surface plasma treatment while preventing the surface of the electrophotographic photosensitive member from being undesirably toughened, while having a due care about the scale and the kind of a vacuum chamber used and also about the size of an electrophotographic photosensitive member. For this purpose, in general, the gas pressure in the vacuum chamber is desired to be adjusted in the range of from 0.3 to 0.7 Torr. And the high frequency power applied is desired to be adjusted in the range of from 300 to 1000 W.

In the following, description will be made of examples of an electrophotograpic apparatus (that is, an electrophotographic copying apparatus) in which an electrophotographic photosensitive member according to The present invention can be used.

Figure 10:
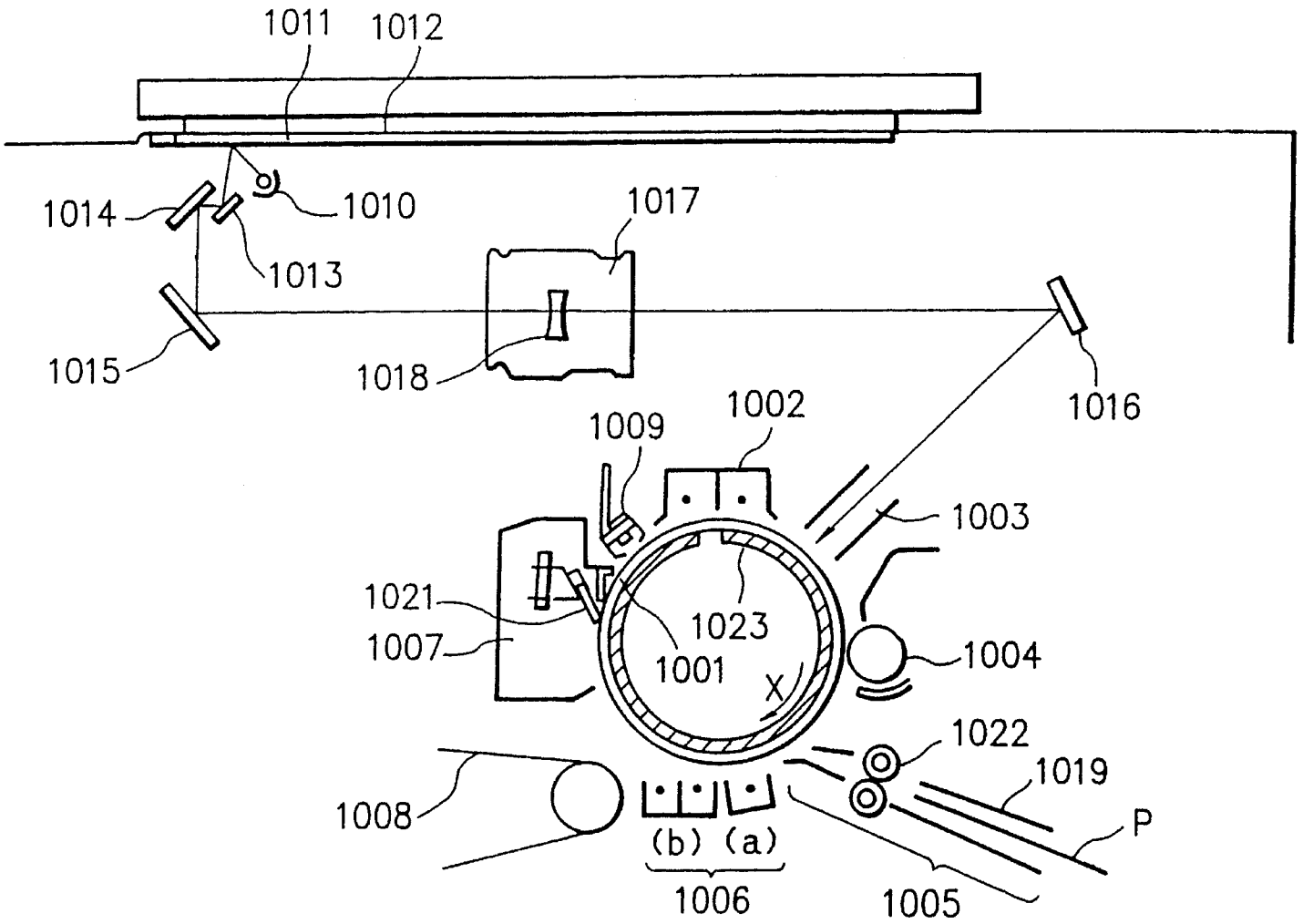
FIGS. 10 and 11 are schematic explanatory views respectively illustrating the constitution of an electrophotograohic copying machine suitable for conducting the image-forming process in the present invention.

Shown in FIG. 10 is an electrophographic copying apparatus provided with a counter blade 1021 as a cleaning means for an electrophotographic photosensitive member, which can be employed for conducting image formation using an electrophotographic photosensitive member according to the present invention. This electrophotographic copying apparatus is a so-called analog type but it may be a laser beam printer (LBP) in which a laser beam is used as the light source.

As shown in FIG. 10, near an electrophotophotographlc photosensitive member 1001 according to the present invention (hereinafter simply referred to as photosensitive member) to be maintained at a desired temperature by means of a heater 1023 which rotates in the direction expressed by an arrow mark x, there are provided a main corona charger 1002, an electrostatic latent image-forming mechanism 1003, a development mechanism 1004, a transfer sheet feeding mechanism 1005, a transfer charger 1006 (a), a separating charger 1006 (b), a cleaning mechanism 1007, a transfer sheet conveying mechanism 1008 and a charger moving lamp 1009.

The image-forming process in the electrophotographic copying apparatus is conducted, for example, in the following manner. That is, the photosensitive member 1001 is uniformly charged by the main corona charger 1002 to which a high voltage of, for example, +6 to +8 kV is impressed. Then, an original 1012 to be copied is irradiated with light from a light source 1010 such as a halogen lamp through a contact glass plate 1011 and the resulting light as reflected is projected through mirrors 1031, 1014 and 1015, a lens system 1017 containing a filter 1018, and a mirror 1016 onto the surface of the photosensitive member 1001 to form an electrostatic latent image corresponding to the original 1012. This electrostatic image is developed with negative toner supplied by the development mechanism 1004 to provide a toner image. A transfer sheet P is supplied through the transfer sheet feeding mechanism 1005 comprising a transfer sheet guide 1019 and a pair of feed timing rollers 1022 so that the transfer sheet P is brought into contact with the surface of the photosensitive member 1001, and corona charging is effected with the positive polarity different from that that of toner from the rear of the transfer sheet P by the transfer charger 1006 (a) to which a high voltage of +7 to +8 kV is applied in order to transfer the negative toner image onto the transfer sheet P. The transfer sheet P having the toner image transferred thereon is electrostatically removed from the photosensitive member 1001 by the charge-removing action of the separating corona charger 1006 (b) where a high AC voltage of 12 to 14 $kV_{p-p}$ is impressed with 300 to 600 Hz and is then conveyed by the transfer sheet conveying mechanism 1008 to a fixing zone (not shown), and the transfer sheet having a toner image fixed thereon is taken out of the apparatus.

The residual toner on the surface of the photosensitive member 1001 is removed by the counter blade 1021 when arrived at the cleaning mechanism 1007, and the removed toner is discharged by way of a waste toner-discharging means (not shown). Thereafter, the photosensitive member 1001 thus cleaned is entirely exposed to light by the charge-removing lamp 1009 to erase the residual charge and is recycled.

Figure 11:
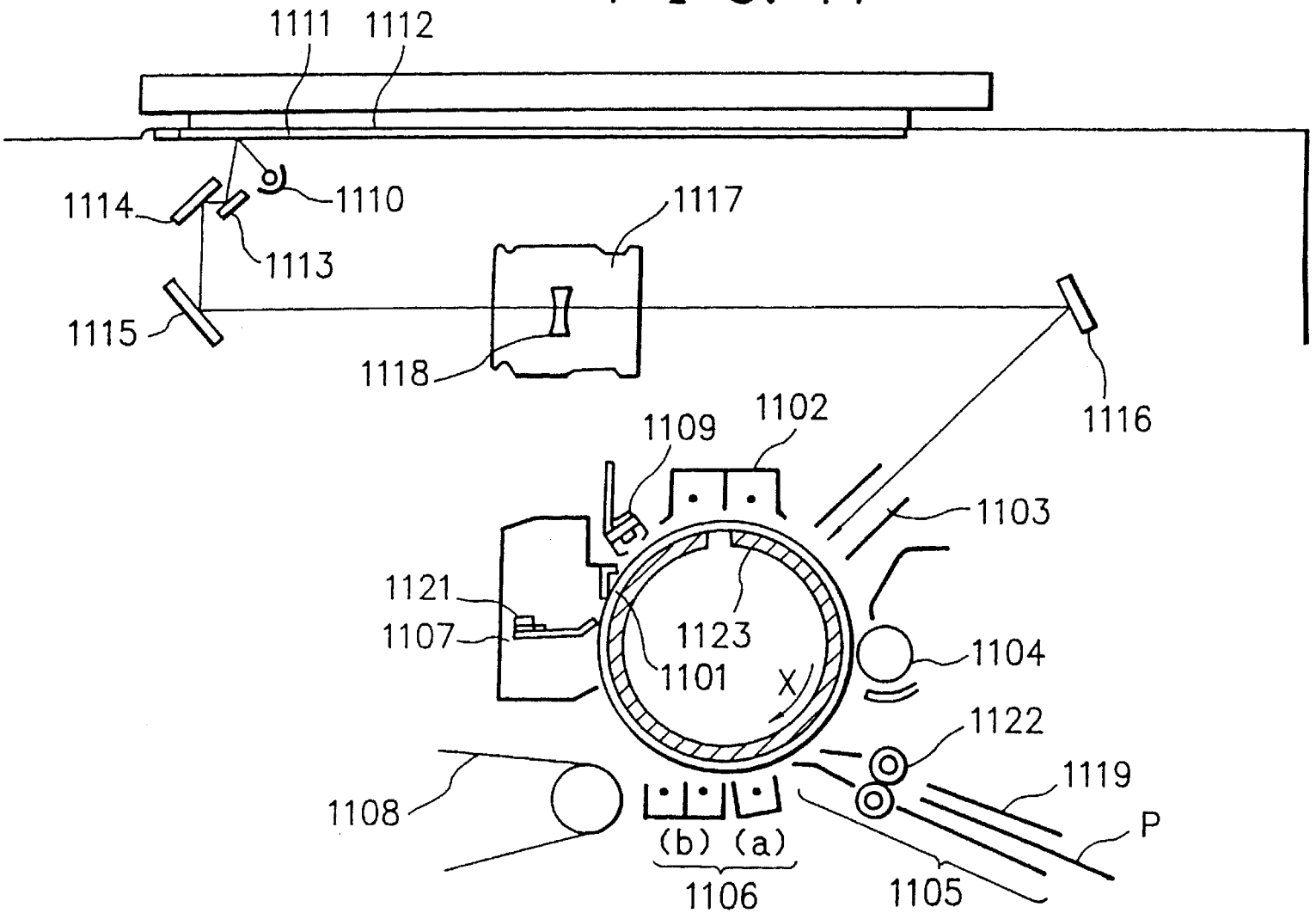

Shown in FIG. 11 is another electrophographic copying apparatus provided with a trailing blade 1121 as a cleaning means for an electrophotographic photosensitive member, which can be employed for conducting image formation using an electrophotographic photosensitive member according to the present invention. This electrophotographic copying apparatus is a so-called analog type but it may be a laser beam printer (LBP) in which a laser beam is used as the light source.

The constitution of the electrophotographic copying apparatus shown in FIG. 11 is the same as that of the electrophotographic copying machine shown in FIG. 10, except that the counter blade 1021 in the electrophotographic copying machine shown in FIG. 10 is replaced by the trailing blade 1121.

Hence, the operation for conducting the image-forming process in the electrophotographic copying apparatus shown in FIG. 11 is the same as that in the electrophotographic copying machine shown in FIG. 10. Therefore, description of the operation for conducting the image-forming process in the electrophotographic copying apparatus shown in FIG. 11 is omitted.

In the following, description will be made of experiments which were conducted by the present inventors in order to accomplish the present invention.

Experiment 1

In this experiment, there were prepared six samples A to F respectively in the following manner, and each of the resultant samples was examined with respect to surface water contact angle and surface sliding property (or surface slip characteristics). The examined results obtained are graphically shown in FIG. 12.

Preparation of sample

Preparation of sample A

An a-Si series photosensitive member having a multilayered light receiving layer comprising a charge injection inhibition layer, a photoconductive layer and a surface layer stacked in the named order on the surface of an aluminum cylinder was prepared in accordance with the foregoing film-forming procedures using the high frequency plasma CVD apparatus shown FIG. 4 under the film-forming conditions shown in Table 1.

The resultant a-Si series photosensitive member was stored in an atmosphere composed Ar gas maintained at 10 Torr in a vacuum vessel.

Preparation of sample B

An a-Si series photosensitive member having a multilayered light receiving layer comprising a charge injection inhibition layer, a photoconductive layer and a surface layer stacked in the named order on the surface of an aluminum cylinder was prepared in accordance with the foregoing film-forming procedures using the high frequency plasma CVD apparatus shown in FIG. 4 under the film-forming conditions shown in Table 1.

The resultant a-Si series photosensitive member was placed in a vacuum vessel, wherein the surface of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

Preparation of sample C

There was provided a coating composition composed of tetraethoxysilane ($Si(OC_2H_5)_4$), water, ethanol and hydrochloric acid. The coating composition was applied onto the surface of an aluminum cylinder by means of the spray coating device shown in FIG. 8, subjecting the coat formed on the aluminum cylinder to heat treatment at 50° C. to convert the coat into a dry gel film which was followed by subjecting to further heat treatment at 300° C., whereby forming a Si—O film on the aluminum cylinder.

Preparation of sample D

There was formed a thin film composed of EVA (ethylene-vinyl acetate copolymer) on the surface of an aluminum cylinder.

Preparation of sample E

There was formed a thin film composed of PVF (polyvinyl fluoride) on the surface of an aluminum cylinder.

Preparation of sample F

There was formed a thin film composed of ETFE (ethylene-tetrafluoroethylene copolymer) on the surface of an aluminum cylinder.

Evaluation

Each of the resultant samples A to F was set to a peeling/slipping/scratching tester HEIDON-14 (produced by Shinto Kagaku Co.), wherein the surface thereof was rubbed by a silicon rubber blade while pulling the silicon rubber blade in the horizontal direction while applying a load of 20 g/cm to the silicon rubber blade, and the surface sliding property at the surface of the sample was examined.

Separately, as for each sample, its surface water contact angle was examined by the conventional surface water contact angle measuring method.

Figure 12:
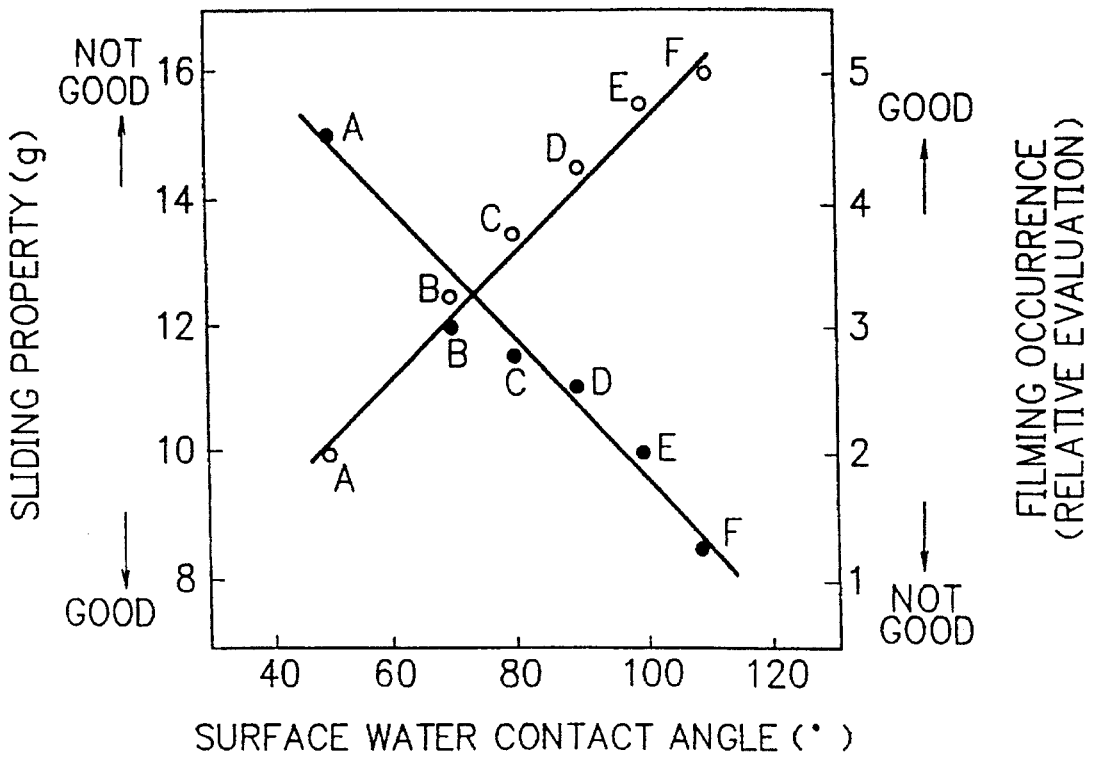
FIG. 12 is a graph showing experimental results with respect to sliding property and occurrence of surface filming in relation to surface water contact angle for electrophotographic photosensitive samples in experiments which will be later described.

The examined results obtained are graphically shown in FIG. 12.

Based on the results shown in FIG. 12, there were obtained findings that the smaller the force required upon pulling the blade is, the better the surface sliding property is; and the greater the surface water contact angle is, the better the surface sliding property is.

Experiment 2

The procedures of preparing each of the samples A to F in Experiment 1 were repeated to thereby obtain six samples A to F.

Each of the resultant samples A to F was set to the electrophotographic apparatus shown in FIG. 11, wherein a developer (toner) was flown over the surface of the sample while rotating the sample 100,000 times during which only a predetermined developing bias voltage was impressed without conducting main discharging and exposure. Thereafter, the situation of the deposition of a developer film on the surface of the sample was examined. The examined results obtained are graphically shown in FIG. 12.

Separately, as for each sample, its surface water contact angle was evaluated by the conventional surface water contact angle measuring method.

The evaluated results obtained are graphically shown in FIG. 12.

Based on the results shown in FIG. 12, there was obtained a finding that the greater the surface water contact angle is, the lesser the deposition of a developer film on the surface is.

Experiment 3

1. There were prepared six a-Si series photosensitive member samples G to L each having a two-layered light receiving layer comprising a charge injection inhibition layer and a photoconductive layer stacked in the named order on the surface of an aluminum cylinder in accordance with the foregoing film-forming procedures using the high frequency plasma CVD apparatus shown in FIG. 4 under the film-forming conditions shown in Table 1.

As for each of the six photosensitive member samples G to L, its surface water contact angle was examined by the conventional surface water contact angle measuring method.

As a result, the six photosensitive member samples G to L were found to have a surface water contact angle in the range of from 70° to 84°.

Particularly, it was found that the photosensitive member sample G has a surface water contact angle of 72°; the photosensitive member sample H a surface contact angle of 82°; the photosensitive member sample I a surface contact angle of 73°; the photosensitive member sample J a surface contact angle of 84°; the photosensitive member sample K a surface contact angle of 70°; and the photosensitive member sample L a surface contact angle of 83°.

2. Each of the photosensitive member samples G to L was treated as follows.

2-(1). The photosensitive member sample G was maintained in a vacuum atmosphere over a predetermined period of time without conducting any treatment therefor.

2-(2). The photosensitive member sample H was maintained in a vacuum atmosphere over a predetermined period of time without conducting any treatment therefor.

2-(3). As for the photosensitive member sample I, its surface was subjected to surface treatment using Ar plasma. And its surface water contact angle was examined. As a result, the surface treated photosensitive member sample I was found to have a surface water contact angle of 60°.

2-(4). As for the photosensitive member sample J, its surface was subjected to surface treatment using Ar plasma. And its surface water contact angle was examined. As a result, the surface treated photosensitive member sample J was found to have a surface water contact angle of 80°.

2-(5). As for the photosensitive member sample K, its surface was subjected to surface treatment using $CF_4$+Ar plasma. And its surface water contact angle was examined. As a result, the surface treated photosensitive member sample K was found to have a surface water contact angle of 77°.

2-(6). As for the photosensitive member sample L, its surface was subjected to surface treatment using $CF_4$ plasma. And its surface water contact angle was examined. As a result, the surface treated photosensitive member sample L was found to have a surface water contact angle of 90°.

3. As for each of the photosensitive member samples obtained in the above 2, a sol dispersion comprising tetraethoxysilane ($Si(OC_2H_5)_4$) dissolved in ethanol was applied onto the surface thereof by means of the spray coating process using the spray coating device shown in FIG. 8, the coat formed was subjected to heat treatment at 50° C. to dry, and the dried coat was subjected to heat treatment at 300° C. to convert the coat into a metal oxide film.

Each photosensitive member sample having the thus formed metal oxide film thereon was set to the electrophotographic apparatus shown in FIG. 11, wherein the image-forming process was continuously conducted 100,000 times. And examination was conducted of whether or net a removal occurred at the metal oxide film. The examined results obtained are graphically shown in FIG. 13.

Figure 13:
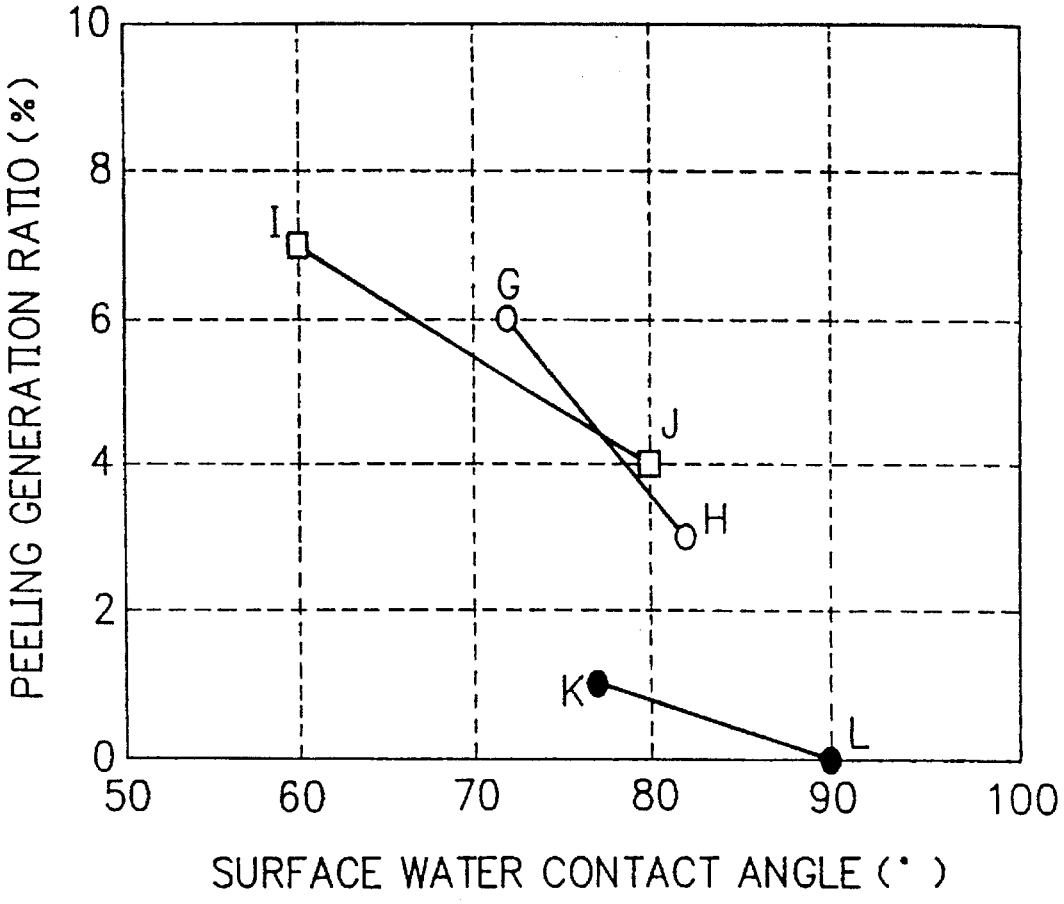
FIG. 13 is a graph showing experimental results with respect to interrelation between peeling occurrence and surface water contact angle for electrophotographic photosensitive samples in experiments which will be later described.

Based on the results shown in FIG. 13, there was obtained a finding that when the surface of a photosensitive member having a multilayered a-Si series light receiving layer formed on an electrically conductive substrate is subjected to etching treatment using a fluorine-containing gas to form a treated surface having a surface water contact angle of 80° or more at the surface of the photosensitive member, a high molecular material sol dispersion obtained by hydrolyzing an organ metallic compound was applied onto said treated surface to form a coat on the treated surface, and the coat thus formed is subjected to heat treatment to thereby convert the coat into a metal oxide film, the resulting metal oxide film extremely excels in adhesion with the surface of the light receiving layer of the photosensitive member.

Experiment 4

There were prepared six a-Si series photosensitive member samples each having a multilayered light receiving layer comprising a charge injection inhibition layer, a photoconductive layer and a surface layer stacked in the named order on the surface of an aluminum cylinder in accordance with the foregoing film-forming procedures using the microwave plasma CVD apparatus shown in FIGS. 5 to 7 under the film-forming conditions shown in Table 2.

1. Of the six photosensitive member samples, two photosensitive member samples were randomly selected. As for each of them, a mixture of tetramethoxysilane ($Si(OCH_3)_4$), water and ethanol was applied onto the surface thereof by the dip coating process using the dip coating device shown in FIG. 9 to form a 0.3 mm thick coat, the coat thus formed was dried at 50° C., and the dried coat was subjected to heat treatment at 200° C. to thereby convert it into a metal oxide film having a thickness of about 1 μm. The metal oxide film thus formed on the surface of each of the two photosensitive member samples was examined with respect to surface water contact angle. As a result, each metal oxide film was found to have a surface water contact angle of 55°.

2. Of the remaining four photosensitive member samples, two photosensitive member samples were randomly selected. As for each of them, a mixture of (tridekafluoro-1,1,2,2-tetrahydrooctyl)triethoxysilane ($C_6F_{13}CH_2CH_2Si(OEt)_3$), water and ethanol was applied onto the surface thereof by the dip coating process using the dip coating device shown in FIG. 9 to form a 0.3 mm thick coat, the coat thus formed was dried at 50° C., and the dried coat was subjected to heat treatment at 200° C. to thereby convert it into a metal oxide film having a thickness of about 1 μm. The metal oxide film thus formed on the surface of each of the two photosensitive member samples was examined with respect to surface water contact angle. As a result, each metal oxide film was found to have a surface water contact angle of 80°.

3. As for each of the remaining two photosensitive member samples, a mixture of (3,3,3-trifluoropropyl)methyldimethoxysilane represented by the general formula:

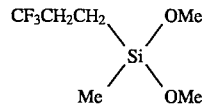

water and ethanol was applied onto the surface thereof by the dip coating process using the dip coating device shown in FIG. 9 to form a 0.3 mm thick coat, the coat thus formed was dried at 50° C., and the dried coat was subjected to heat treatment at 200° C. to thereby convert it into a metal oxide film having a thickness of about 1 μm. The metal oxide film thus formed on the surface of each of the two photosensitive member samples was examined with respect to surface water contact angle. As a result, each metal oxide film was found to have a surface water contact angle of 75°.

Based on the results obtained in the above 1 to 3, there was obtained a finding that in the case of forming a surface coat comprising a metal oxide film using a fluorine-containing metal alkoxide compound on the surface of the a-Si series light receiving layer of a photosensitive member, there can be attained a desirable metal oxide surface coat having an improved surface water contact angle.

Experiment 5

There were prepared twelve a-Si series photosensitive member samples each having a two-layered light receiving layer comprising a charge injection inhibition layer and a photoconductive layer stacked in the named order on the surface of an aluminum cylinder in accordance with the foregoing film-forming procedures using the microwave plasma CVD apparatus shown in FIGS. 5 to 7 under the film-forming conditions shown in Table 2 (excluding the conditions for forming a surface layer).

1. Of the twelve photosensitive member samples, six photosensitive member samples were randomly selected. As for each of the six photosensitive member samples, a mixture of (tridekafluoro-1,1,2,2-tetrahydrooctyl)triethoxysilane ($C_6F_{13}CH_2CH_2Si(OEt)_3$), water and ethanol was applied onto the surface thereof by the dip coating process using the dip coating device shown in FIG. 9 to form a 0.3 mm thick coat, the coat thus formed was dried at 50° C., and the dried coat was subjected to heat treatment at 200° C. to thereby convert it into a metal oxide film having a thickness of about 1 μm as a surface protective layer. Successively, on the surface of the surface protective layer comprising the metal oxide film of each sample, a coating composition comprised of a chlorotrifluoroethylene-vinyl copolymer resin (trademark name: LUMIFLON, produced by Asahi Glass Co., Ltd.) having a different acid value, dicuminyl peroxide as a crosslinking agent, and xylene as a solvent was applied by the spray coating process using the spray coating device shown in FIG. 8 in an amount to provide a thickness of about 0.5 μm when dried, followed by drying at 60° C. for 30 minutes, to thereby form an about 0.5 μm thick fluorine-containing resin layer. Thus, there were obtained six a-Si photosensitive members.

2. As for each of the remaining six photosensitive member samples, the procedures in the above 1 were repeated, except that the procedures of forming the metal oxide film as the surface protective layer were not conducted, to thereby obtain six a-Si photosensitive members having no metal oxide surface protective layer.

Evaluation

As for each of the photosensitive member samples obtained in the above 1 and 2, a stainless foil was laminated on the surface of the fluorine-containing layer using an adhesive. The resultant was set to a peeling/slipping/scratching tester HEIDON-14 (produced by Shinto Kagaku Co.), wherein the adhesion (that is, the bonding strength) of the fluorine-containing resin layer per unit area was examined by peeling the stainless foil. Particularly, as for each of the photosensitive member samples obtained in the above 1, the adhesion at the interface between the fluorine-containing resin layer and the metal oxide surface protective layer was examined. As for each of the photosensitive member samples obtained in the above 2, the adhesion at the interface between the fluorine-containing resin layer and the a-Si light receiving layer was examined.

Figure 14:
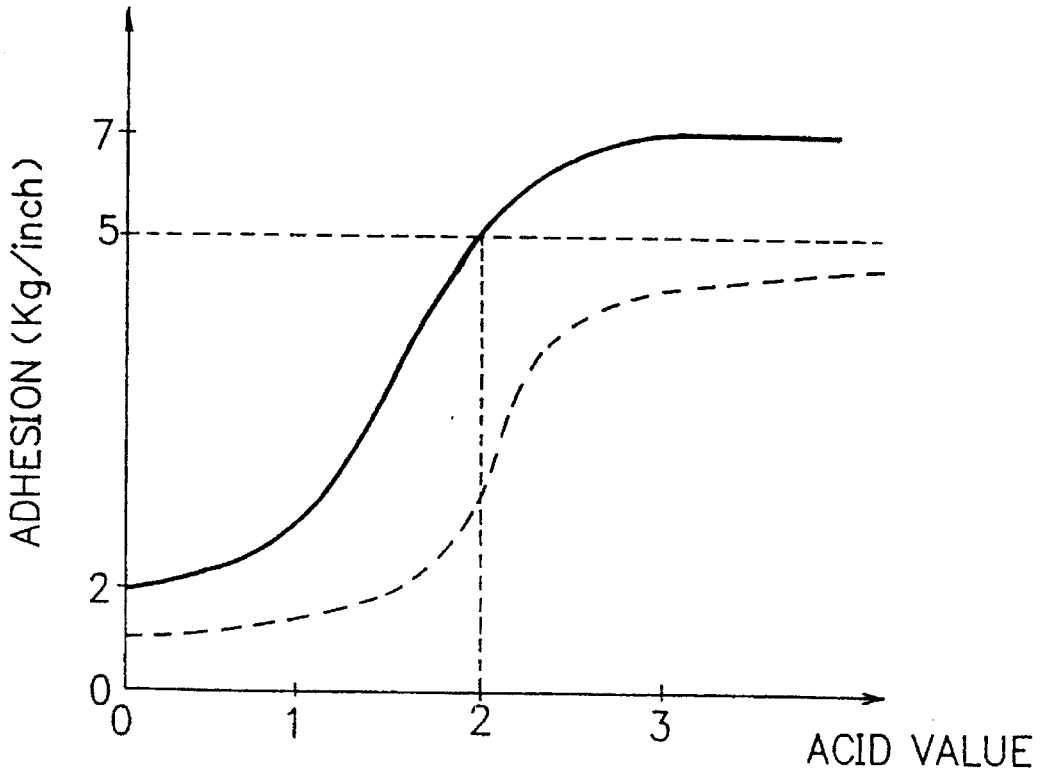
FIG. 14 is a graph showing experimental results with respect to interrelation between the acid value of a surface constituent and adhesion for electrophotographic photosensitive samples in experiments which will be later described.

The examined results obtained as for the photosensitive members obtained in the above 1 provided a solid line curve in terms of the interrelation between the adhesion of the fluorine-containing resin layer and the acid value of the constituent fluororesin of said resin layer shown in FIG. 14. The examined results obtained as for the photosensitive members obtained in the above 1 provided a solid line curve in terms of the interrelation between the adhesion of the fluorine-containing resin layer and the acid value of the constituent fluororesin of said resin layer shown in FIG. 14.

Based on the results shown in FIG. 14, there were obtained findings that when a chlorotrifluoroethylene-vinyl copolymer resin having an acid value of 2 or more is used, there can be attained a desirable surface coat for the surface of the metal oxide surface protective layer or a-Si light receiving layer of an a-Si photosensitive member wherein the surface coat excels in adhesion with the metal oxide surface protective layer or a-Si light receiving layer; and in the case of using said chlorotrifluoroethylene-vinyl copolymer resin in the formation of a fluorine-containing resin layer on the metal oxide surface protective layer, the fluorine-containing layer is formed in a state that it extremely excels in adhesion with the metal oxide surface protective layer.

Experiment 6

There were prepared twelve a-Si series photosensitive member samples each having a two-layered light receiving layer comprising a charge injection inhibition layer and a photoconductive layer stacked in the named order on the surface of an aluminum cylinder in accordance with the foregoing film-forming procedures using the microwave plasma CVD apparatus shown in FIGS. 5 to 7 under the film-forming conditions shown in Table 2 (excluding the conditions for forming a surface layer).

1. Of the twelve photosensitive member samples, six photosensitive member samples were randomly selected. As for each of the six photosensitive member samples, a mixture of (tridekafluoro-1,1,2,2-tetrahydrooctyl)triethoxysilane ($C_6F_{13}CH_2CH_2Si(OEt)_3$), water and ethanol was applied onto the surface thereof by the dip coating process using the dip coating device shown in FIG. 9 to form a 0.3 mm thick coat, the coat thus formed was dried at 50° C., and the dried coat was subjected to heat treatment at 200° C. to thereby convert it into a metal oxide film having a thickness of about 1 μm as a surface protective layer. Successively, on the surface of the surface protective layer comprising the metal oxide film of each sample, a coating composition comprised of a chlorotrifluoroethylene-vinyl copolymer resin (trademark name: LUMIFLON, produced by Asahi Glass Co., Ltd.) having a different hydroxyl value, dicuminyl peroxide as a crosslinking agent, and xylene as a solvent was applied by the spray coating process using the spray coating device shown in FIG. 8 in an amount to provide a thickness of about 0.5 μm when dried, followed by drying at 60° C. for 30 minutes, to thereby form an about 0.5 μm thick fluorine-containing resin layer. Thus, there were obtained six a-Si photosensitive members.

2. As for each of the remaining six photosensitive member samples, the procedures in the above 1 were repeated, except that the procedures of forming the fluorine-containing resin layer were not conducted, to thereby obtain six a-Si photosensitive members having no fluorine-containing resin layer.

Evaluation (1). As for the six photosensitive members obtained in the above 2, their weight was measured. And there was obtained a mean value (a-i) among the measured results.

Then, as for each of the six photosensitive members obtained in the above 2, it was maintained in an atmosphere of 40° C. and 90%RH for a week. As for the six photosensitive members thus treated, their weight was measured. And there was obtained a mean value (a-ii) among the measured results.

Based on the mean value (a-i) and the mean value (a-ii), there was obtained a mean moisture content (a-iii).

(2). As for the photosensitive members obtained in the above 1, their weight was measured. Thus, there were obtained six weight values (b-i) for the six photosensitive member.

Then, as for each of the six photosensitive members obtained in the above 1, it was maintained in an atmosphere of 40° C. and 90%RH for a week- As for each of the six photosensitive members thus treated, its weight was measured. Thus, there was obtained six weight values (b-ii) for the six photosensitive members.

Each weight value (b-ii) was compared with the corresponding weight value (b-i) to obtain a moisture content (b-iii) as for each of the six photosensitive member. Thus, there were obtained six moisture contents (b-iii).

Each moisture content (b-iii) was compared with the mean moisture content (a-iii) obtained in the above (1) to thereby obtain a change proportion in terms of the moisture content (that is, the moisture resistance) as for each of the six photosensitive members obtained in the above 1.

The evaluated results obtained as for the six photosensitive members obtained in the above 1 provided a solid line curve in terms of the interrelation between the moisture resistance and the hydroxyl value of the constituent fluororesin of the fluorine-containing resin layer shown in FIG.

Figure 15:
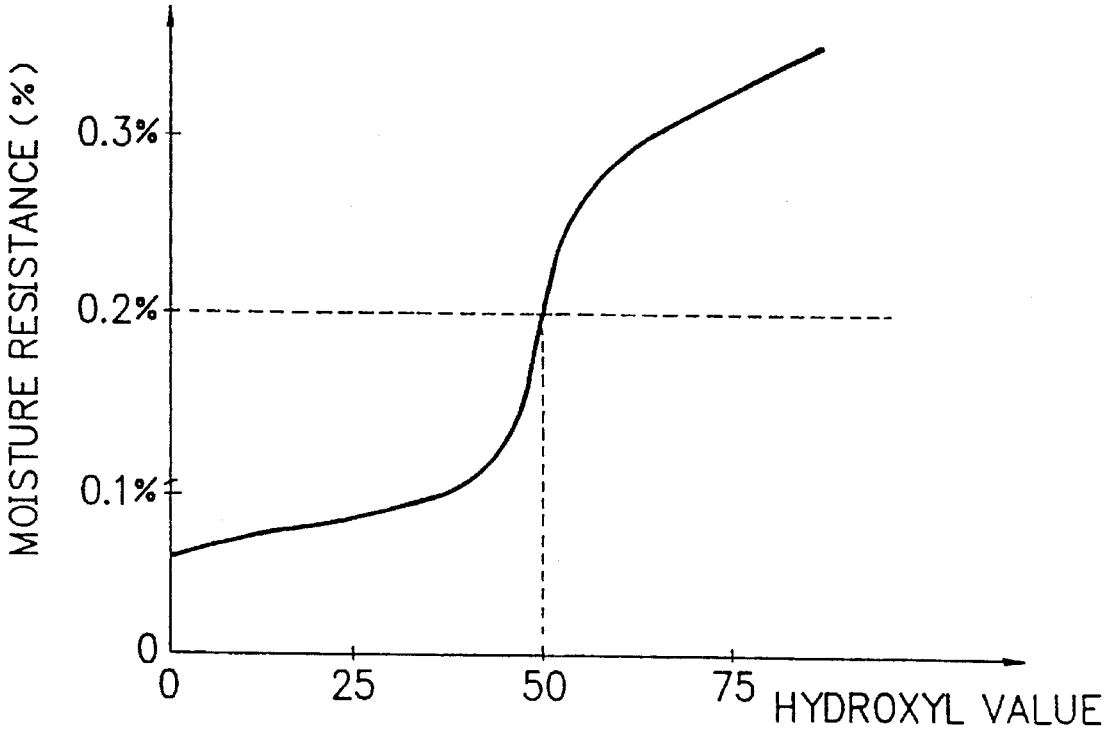
FIG. 15 is a graph showing experimental results with respect to interrelation between the hydroxyl value of a surface constituent and moisture resistance for electrophotographic photosensitive samples in experiments which will be later described.

Based on the results shown in FIG. 15, there were obtained findings that when a chlorotrifluoroethylene-vinyl copolymer resin having a hydroxyl value exceeding 50 is used for the formation of the fluorine-containing resin layer for an a-Si photosensitive member, the resulting photosensitive member becomes such that is remarkably inferior in moisture resistance and that has a fear of causing a smeared image in image formation; and it is desired to form the fluorine-containing layer using a chlorotrifluoroethylene-vinyl copolymer resin having a hydroxyl value of less than 50.

Experiment 7

In this experiment, there were prepared two kinds of a a-Si series photosensitive member sample, and evaluation was conducted with respect to occurrence of deposition of a developer film and cleaning property in the image-forming process.

Preparation of Photosensitive Member Sample

Preparation of photosensitive member sample M:

There were prepared four a-Si series photosensitive member samples each having a two-layered light receiving layer comprising a charge injection inhibition layer and a photoconductive layer stacked in the named order on the surface of an aluminum cylinder in accordance with the foregoing film-forming procedures using the high frequency plasma CVD apparatus shown in FIG. 4 under the film-forming conditions shown in Table 1 (excluding the conditions for forming a surface layer).

Each of the photosensitive member samples obtained was placed in a vacuum vessel, wherein the surface of the photosensitive member sample was subjected to etching treatment for 10 minutes using a plasma generated by introducing $CF_4$ gas therein at a flow rate of 500 sccm, maintaining the gas pressure at 0.6 Torr, and applying a RF power (13.56 MHz). Then, on the surface thus treated, a sol dispersion comprised of silicon tetraacetylacetonate, water, ethanol and hydrochloric acid was applied by the spray coating process using the spray coating device shown in FIG. 8 to form a coat composed of said sol dispersion. The coat thus formed was dried at 50° C. to remove the solvent contained therein, followed by subjecting to heat treatment at 250° C. to thereby convert into a metal oxide film as a surface protective layer. Thus, there were obtained four a-Si photosensitive members each having a surface protective layer comprising said metal oxide film.

Preparation of photosensitive member sample N:

There were prepared four a-Si series photosensitive member samples each having a two-layered light receiving layer comprising a charge injection inhibition layer and a photoconductive layer stacked in the named order on the surface of an aluminum cylinder in accordance with the foregoing film-forming procedures using the high frequency plasma CVD apparatus shown in FIG. 4 under the film-forming conditions shown in Table 1 (excluding the conditions for forming a surface layer).

Each of the photosensitive member samples obtained was placed in a vacuum vessel, wherein the surface of the photosensitive member sample was subjected to etching treatment for 10 minutes using a plasma generated by introducing $CF_4$ gas therein at a flow rate of 500 sccm, maintaining the gas pressure at 0.6 Torr, and applying a RF power (13.56 MHz). Then, on the surface thus treated, a sol dispersion comprised of silicon tetraacetylacetonate, water, ethanol and hydrochloric acid was applied by the spray coating process using the spray coating device shown in FIG. 8 to form a coat composed of said sol dispersion. The coat thus formed was dried at 50° C. to remove the solvent contained therein, followed by subjecting to heat treatment at 250° C. to thereby convert into a metal oxide film as a surface protective layer. Successively, on the surface of the metal oxide film, a coating composition comprised of a chlorotrifluoroethylene-vinyl copolymer resin having an acid value of 2 mg KOH/g and a hydroxyl value of 48 mg KOH/g, dicuminyl peroxide as a crosslinking agent, and xylene as a solvent was applied by the spray coating process using the spray coating device shown in FIG. 8 in an amount to provide a thickness of about 0.5 μm when dried, followed by drying at 60° C. for 30 minutes, to thereby form an about 0.5 μm thick fluorine-containing resin layer. Thus, there were obtained four a-Si photosensitive members each having a surface protective layer comprising the above metal oxide film and a fluorine-containing resin layer disposed thereon.

Evaluation (1). As for each of the photosensitive member samples M and N obtained in the above, it was set to the electrophotographic apparatus shown in FIG. 10 having the counter blade, wherein the image-forming process was continuously conducted 100,000 times at different image-forming process speeds. And as for the photosensitive member sample thus repeatedly dedicated for the image-forming process, evaluation was conducted of the situation of a developer film having deposited on the surface of the photosensitive member. The evaluated results obtained was provided a curve shown in shown in FIG. 16(A).

Separately, as for each of the photosensitive member samples M and N obtained in the above, it was set to the electrophotographic apparatus shown in FIG. 11 having the trailing blade, wherein the image-forming process was continuously conducted 100,000 times at different image-forming process speeds. And as for the photosensitive member sample thus repeatedly dedicated for the image-forming process, evaluation was conducted of the situation of a developer film having deposited on the surface of the photosensitive member. The evaluated results obtained was provided a curve shown in shown in FIG. 16(B).

Figure 16A:
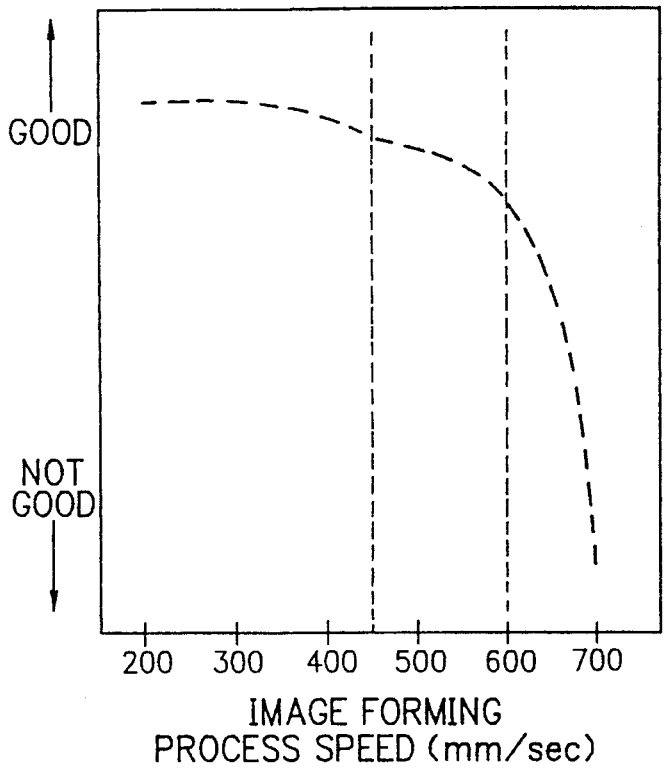
FIGS. 16(A) through 16(D) are graphs respectively showing experimental results with respect to interrelation between pressure of a cleaning means (a counter blade or trailing blade) and cleaning property for electrophotographic photosensitive samples in experiments which will be later described.

From the results shown in FIG. 16(A), it was found that in the case of continuously conducting the image-forming process in the electrophotographic apparatus having the counter blade, any of the photosensitive member samples M and N does not cause distinct deposition of a developer film thereon as long as the image-forming process speed is made to be less than 600 mm/sec.

Figure 16B:
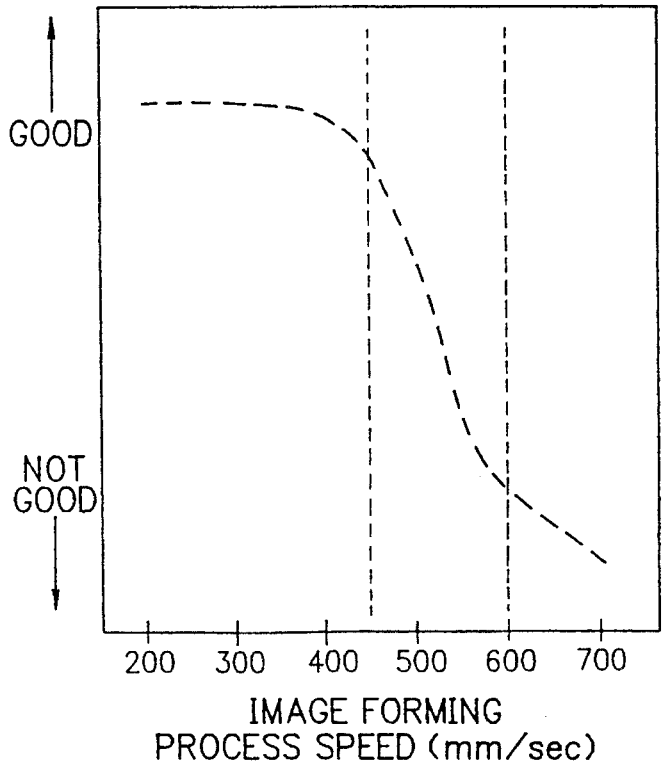

From the results shown in FIG. 16(B), it was found that in the case of continuously conducting the image-forming process in the electrophotographic apparatus having the trailing blade, any of the photosensitive member samples M and N causes distinct deposition of a developer film thereon when the image-forming process speed is made to be higher than 450 mm/sec.

Figure 16C:
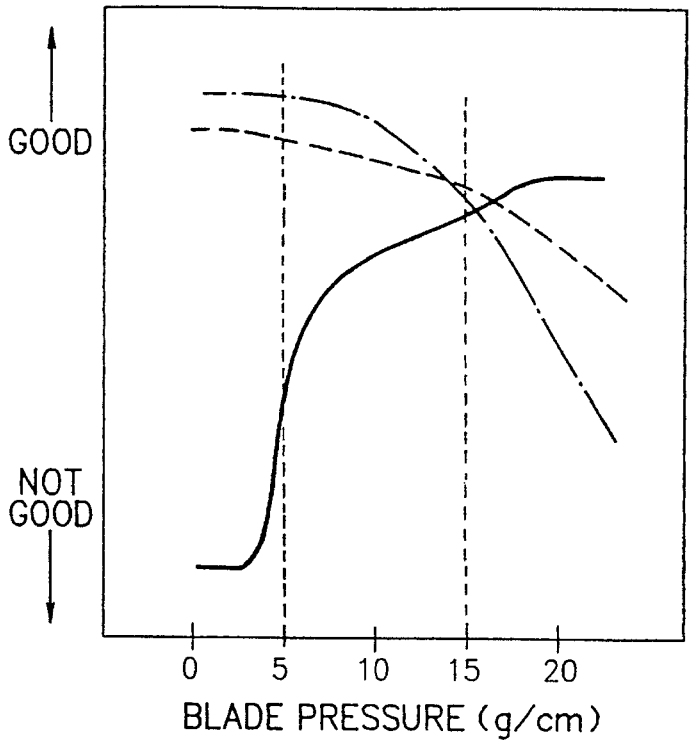

(2). As for each of the photosensitive member samples M and N obtained in the above, it was set to the electrophotographic apparatus shown in FIG. 10 having the counter blade, wherein the image-forming process was continuously conducted 100,000 times at a fixed image-forming process speed of 500 mm/sec and at different blade pressures. And as for the photosensitive member sample, evaluation was conducted with respect to abrasion resistance and cleaning property (specifically, developer scraping property). The evaluated results obtained was provided three curves shown in shown in FIG. 16(C).

Figure 16D:
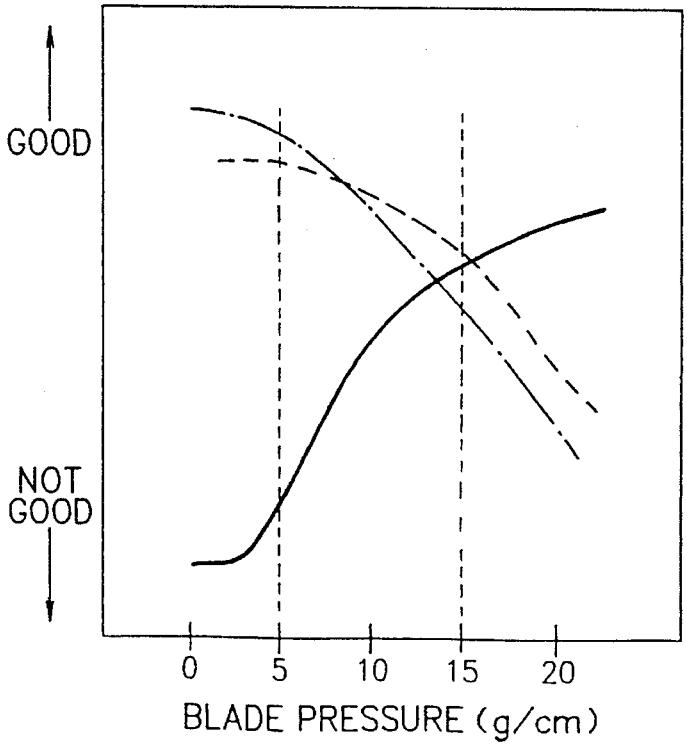

Separately, as for each of the photosensitive member samples M and N obtained in the above, it was set to the electrophotographic apparatus shown in FIG. 11 having the trailing blade, wherein the image-forming process was continuously conducted 100,000 times at a fixed image-forming process speed of 500 mm/sec and at different blade pressures. And as for the photosensitive member sample, evaluation was conducted with respect to abrasion resistance and cleaning property (specifically, developer scraping property). The evaluated results obtained was provided three curves shown in shown in FIG. 16(D).

From the results obtained, there were obtained findings that in the case of continuously conducting the image-forming process using an electrophotographic apparatus having a counter blade, there is present a desirable blade pressure region of 5 to 15 g/cm for any of the photosensitive members M and N; in the case of continuously conducting the image-forming process using an electrophotographic apparatus having a trailing blade, there is present no desirable blade pressure region for any of the photosensitive members M and N; and any of the photosensitive member samples M and N markedly excels in cleaning property when it is used in the case of continuously conducting the image-forming process at a high image-forming process speed of 450 mm/sec to 600 mm/sec using an electrophotographic apparatus having a counter blade as the cleaning means wherein the contact linear load of the cleaning means is made to be in the range of 5 to 15 g/cm.

The contact linear load herein means a load applied along the length of the cleaning means upon cleaning the surface of the photosensitive member. For instance, in the case where the cleaning means has a length of 30 cm to be contacted with the surface of the photosensitive member, when the cleaning means is contacted with the surface of the photosensitive member by applying a load of 300 g to the cleaning means, the contact linear load in this case is 10 g/cm.

Experiment 8

Figure 17:
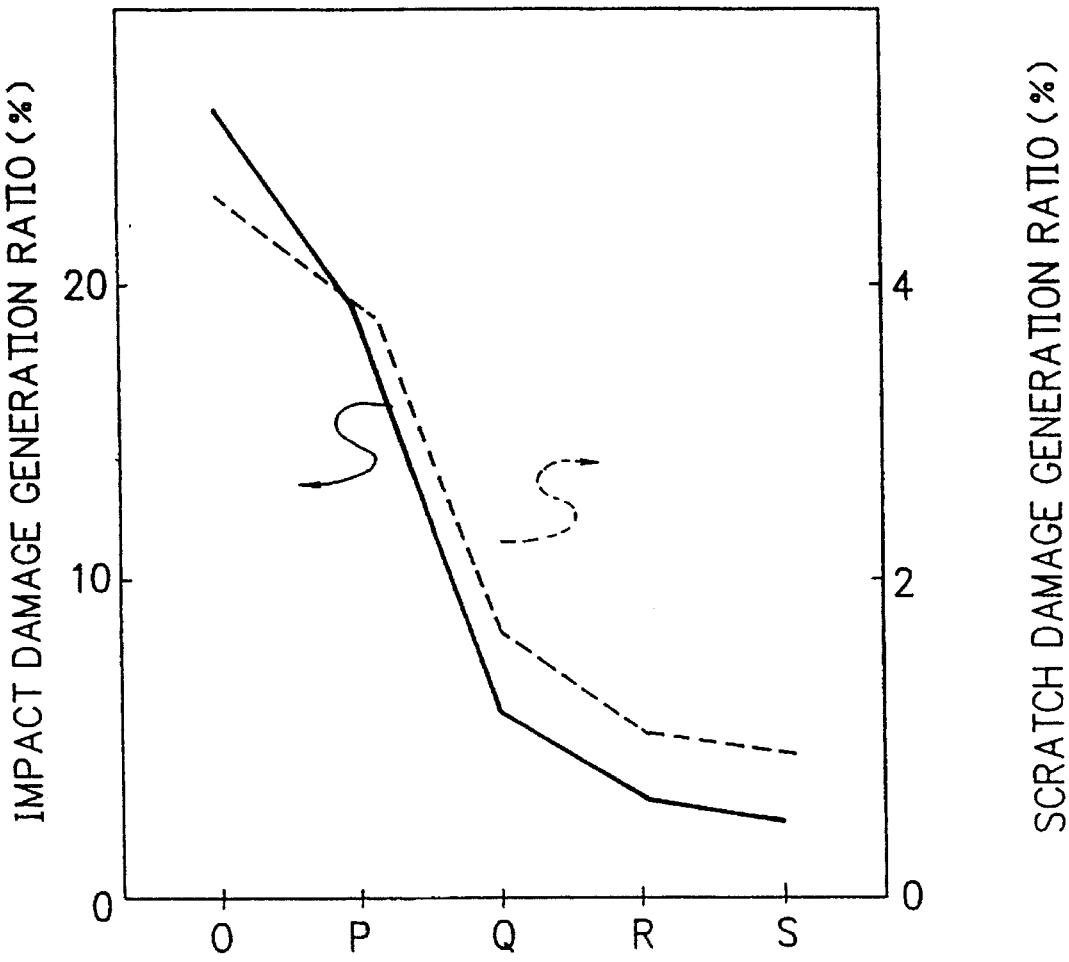
FIG. 17 is a graph showing experimental results with respect to impact damage occurrence and scratch damage occurrence for electrophotographic photosensitive samples in experiments which will be later described.

In this experiment, there were prepared five kinds of photosensitive member samples O to S respectively in the following manner, and each of the resultant samples was evaluated with respect to surface state. The evaluated results obtained are graphically shown in FIG. 17.

Preparation of sample

Preparation of photosensitive member sample O:

Two a-Si series photosensitive members each having a three-layered light receiving layer comprising a charge injection inhibition layer, a photoconductive layer and a surface layer stacked in the named order on the surface of an aluminum cylinder were prepared in accordance with the foregoing film-forming procedures using the high frequency plasma CVD apparatus shown FIG. 4 under the film-forming conditions shown in Table 1.

Preparation of photosensitive member sample p:

Two a-Si series photosensitive members each having a two-layered light receiving layer comprising a charge injection inhibition layer and a photoconductive layer stacked in the named order on the surface of an aluminum cylinder were prepared in accordance with the foregoing film-forming procedures using the high frequency plasma CVD apparatus shown FIG. 4 under the film-forming conditions shown in Table 1 (excluding the conditions for the formation of the surface layer).

On the surface of each resultant photosensitive member, a sol dispersion comprised of tetraethoxysilane ($Si(OC_2HS)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer.

Preparation of photosensitive member sample Q:

Two a-Si series photosensitive members each having a two-layered light receiving layer comprising a charge injection inhibition layer and a photoconductive layer stacked in the named order on the surface of an aluminum cylinder were prepared in accordance with the foregoing film-forming procedures using the high frequency plasma CVD apparatus shown in FIG. 4 under the film-forming conditions shown in Table 1 (excluding the conditions for the formation of the surface layer).

Each resultant photosensitive member was placed in a vacuum vessel, wherein the surface of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

Successively, on the plasma-treated surface of the photosensitive member, a sol dispersion comprised of tetraethoxysilane ($Si(OC_2H_5)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer.

Preparation of photosensitive member sample R:

Two a-Si series photosensitive members each having a three-layered light receiving layer comprising a charge injection inhibition layer, a photoconductive layer and a surface layer stacked in the named order on the surface of an aluminum cylinder were prepared in accordance with the foregoing film-forming procedures using the high frequency plasma CVD apparatus shown FIG. 4 under the film-forming conditions shown in Table 1.

Each resultant photosensitive member was placed in a vacuum vessel, wherein the surface of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

Successively, on the plasma-treated surface of the photosensitive member, a sol dispersion comprised of tetraethoxysilane ($Si(OC_2H_5)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer.

Preparation of photosensitive member sample S:

Two a-Si series photosensitive members each having a three-layered light receiving layer comprising a charge injection inhibition layer, a photoconductive layer and a surface layer stacked in the named order on the surface of an aluminum cylinder were prepared in accordance with the foregoing film-forming procedures using the high frequency plasma CVD apparatus shown FIG. 4 under the film-forming conditions shown in Table 1.

Each resultant photosensitive member was placed in a vacuum vessel, wherein the surface of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

Successively, on the plasma-treated surface of the photosensitive member, a sol dispersion comprised of tetraethoxysilane ($Si(OC_2H_5)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer. Then, on the surface of the metal oxide surface protective layer, a coating composition comprised of a chlorotrifluoroethylene-vinyl ether copolymer resin having an acid value of 2 mg KOH/g and a hydroxyl value of 48 mg KOH/g, dicuminyl peroxide as a crosslinking agent and xylene as a solvent was applied by the spray coating process using the spray coating device shown in FIG. 8 in an amount to provide a thickness of about 0.5 μm when dried, followed by drying at 60° C. for 30 minutes, to thereby form a fluorine-containing resin layer having an about 0.5 μm on the metal oxide surface protective layer.

Evaluation (1). Each of the resultant photosensitive member samples O to S was evaluated with respect to impact damage generation ration by falling down a plurality of stainless steel bolls having a diameter of 2.5 mm against the surface of the photosensitive member horizontally laid from the height of 10 cm. The evaluated results obtained provided a solid curve shown in FIG. 17.

(2). Each of the resultant photosensitive member samples O to S was set to a peeling/slipping/scratching tester HEIDON-14 (produced by Shinto Kagaku Co.), wherein a diamond needle having a diameter of 0.1 mm was moved so as to scratch the surface of the photosensitive member sample in the direction in parallel to the cental axis of the photosensitive member sample while applying a load of 50 g to the needle, whereby the scratch damage generation ratio at the surface of the photosensitive member sample was evaluated. The evaluated results obtained provided a broken line curve shown in FIG. 17.

Based on the evaluated results obtained, there were obtained findings that when a metal oxide layer as a surface protective layer is formed on the surface of a-Si light receiving layer which has been applied with plasma surface treatment, there is attained a remarkable improvement in the surface strength of an photosensitive member; this situation is further improved when the a-Si light receiving layer is provided with a surface layer; and when a fluorine-containing layer is disposed on the metal oxide surface protective layer, a still further improved surface strength is attained for the photosensitive member.

Now, in the above evaluation (1), the impact damage generation ratio is desired to be preferably less than 50%, more preferably less than 20%, most preferably less than 10%. Depending upon the results obtained in this evaluation, it can be distinguished of whether the photosensitive member involved has a desired impact damage resistance and whether it can be reused.

In the above evaluation (2), depending upon the results obtained, it can be distinguished of whether the photosensitive member involved has a desired scratch damage resistance and whether it can be reused.

The present invention has been accomplished based on the results obtained in the above experiments.

In the following, the present invention will be described with reference to examples, which are for illustrative purposes only but not are intended to restrict the scope of the invention.

EXAMPLE 1

An a-Si series photosensitive member having a three-layered light receiving layer comprising a charge injection inhibition layer, a photoconductive layer and a surface layer stacked in the named order on the surface of an aluminum cylinder of 108 mm in outer diameter was prepared in accordance with the foregoing film-forming procedures using the high frequency plasma CVD apparatus shown FIG. 4 under the film-forming conditions shown in Table 1.

The surface of the resultant photosensitive member was found to have a surface water contact angle of 62°.

The resultant photosensitive member was placed in a vacuum vessel, wherein the surface of the light receiving layer of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

The surface of the resultant was found to have a surface water contact angle of 84°.

Successively, on the plasma-treated surface of the photosensitive member, a sol dispersion comprised of tetraethoxysilane ($Si(OC_2H_5)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer.

Thus, there was obtained an electrophotographic photosensitive member.

The electrophotographic photosensitive member was to the electrophotographic apparatus shown in FIG. 10, wherein the image-forming process was continuously conducted 500,000 times under conditions of 460 mm/sec for the image-forming process speed and 12 g/cm for the blade pressure upon conducting cleaning for the surface of the electrophotographic photosensitive member. As a result, all the 500,000 copied products obtained were found to be excelling in image quality.

EXAMPLE 2

An a-Si series photosensitive member having a three-layered light receiving layer comprising a charge injection inhibition layer, a photoconductive layer and a surface layer stacked in the named order on the surface of an aluminum cylinder of 108 mm in outer diameter was prepared in accordance with the foregoing film-forming procedures using the high frequency plasma CVD apparatus shown FIG. 4 under the film-forming conditions shown in Table 1.

The surface of the resultant photosensitive member was found to have a surface contact angle of 65°.

The resultant photosensitive member was placed in vacuum vessel, wherein the surface of the light receiving layer of the photosensitive member was subjected to etching treatment for 10 minutes using a plasma generated by introducing $CHF_3$ gas therein at a flow rate of 400 sccm, maintaining the gas pressure at 0.6 Torr, and applying a RF power (13.56 MHz) of 500 W.

The surface of the resultant was found to have a surface water contact angle of 81°.

Successively, on the plasma-treated surface of the photosensitive member, a sol dispersion comprised of tetraethoxysilane ($Si(OC_2H_5)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer. Then, on the surface of the metal oxide surface protective layer, a coating composition comprised of a chlorotrifluoroethylene-vinyl ether copolymer resin having an acid value of 2 mg KOH/g and a hydroxyl value of 48 mg KOH/g, 2,5-dimethyl-2,5-bis(t-butylperoxy)hexane as a crosslinking agent and xylene as a solvent was applied by the spray coating process using the spray coating device shown in FIG. 8 in an amount to provide a thickness of about 0.5 μm when dried, followed by drying at 60° C. for 30 minutes, to thereby form a fluorine-containing resin layer having a thickness of about 0.5 μm on the metal oxide surface protective layer.

Thus, there was obtained an electrophotographic photosensitive member.

The electrophotographic photosensitive member was set to the electrophotographic apparatus shown in FIG. 10, wherein the image-forming process was continuously conducted 500,000 times under conditions of 460 mm/sec for the image-forming process speed and 12 g/cm for the blade pressure upon conducting cleaning for the surface of the electrophotographic photosensitive member. As a result, all the 500,000 copied products obtained were found to be excelling in image quality.

Comparative Example 1

The procedures of Example 2 were repeated, except that the surface of the light receiving layer of the photosensitive member was not subjected to the surface plasma treatment, to thereby obtain an electrophotographic photosensitive member.

The resultant electrophotographic photosensitive member was evaluated in the same manner as in Example 2.

As a result, some of the 500,000 copied products were found to be accompanied by scratch-like defects.

EXAMPLE 3

An a-Si series photosensitive member having a three-layered light receiving layer comprising a charge injection inhibition layer, a photoconductive layer and a surface layer stacked in the named order on the surface of an aluminum cylinder of 108 mm in outer diameter was prepared in accordance with the foregoing film-forming procedures using the high frequency plasma CVD apparatus shown FIG. 4 under the film-forming conditions shown in Table 1.

The surface of the resultant photosensitive member was found to have a surface contact angle of 70°.

The resultant photosensitive member was placed in a vacuum vessel, wherein the surface of the light receiving layer of the photosensitive member was subjected to etching treatment for 10 minutes using a plasma generated by introducing $C_2F_6$ gas therein at a flow rate of 300 sccm, maintaining the gas pressure at 0.6 Torr, and applying a RF power (13.56 MHz) of 700 W.

The surface of the resultant was found to have a surface water contact angle of 83°.

Successively, on the plasma-treated surface of the photosensitive member, a sol dispersion comprised of tetramethoxysilane ($Si(OCH_3)_4$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer. Then, on the surface of the metal oxide surface protective layer, a coating composition comprised of a chlorotrifluoroethylene-vinyl ether copolymer resin having an acid value of 3 mg KOH/g and a hydroxyl value of 44 mg KOH/g, dicuminyl peroxide as a crosslinking agent and xylene as a solvent was applied by the spray coating process using the spray coating device shown in FIG. 8 in an amount to provide a thickness of about 0.5 μm when dried, followed by drying at 60° C. for 30 minutes, to thereby form a fluorine-containing resin layer having a thickness of about 0.5 μm on the metal oxide surface protective layer.

Thus, there was obtained an electrophotographic photosensitive member.

The electrophotographic photosensitive member was set to the electrophotographic apparatus shown in FIG. 10, wherein the image-forming process was continuously conducted 500,000 times under conditions of 600 mm/sec for the image-forming process speed and 15 g/cm for the blade pressure upon conducting cleaning for the surface of the electrophotographic photosensitive member. As a result, all the 500,000 copied products obtained were found to be excelling in image quality.

EXAMPLE 4

An a-Si series photosensitive member having a three-layered light receiving layer comprising a charge injection inhibition layer, a photoconductive layer and a surface layer stacked in the named order on the surface of an aluminum cylinder of 108 mm in outer diameter was prepared in accordance with the foregoing film-forming procedures using the high frequency plasma CVD apparatus shown FIG. 4 under the film-forming conditions shown in Table 1.

The surface of the resultant photosensitive member was found to have a surface contact angle of 75°.

The resultant photosensitive member was placed in a vacuum vessel, wherein the surface of the light receiving layer of the photosensitive member was subjected to etching treatment for 10 minutes using a plasma generated by introducing $CF_4$ gas therein at a flow rate of 500 sccm, maintaining the gas pressure at 0.6 Torr, and applying a RF power (13.56 MHz) of 500 W.

The surface of the resultant was found to have a surface water contact angle of 85°.

Successively, on the plasma-treated surface of the photosensitive member, a sol dispersion comprised of (tridekafluoro-1,1,2,2-tetrahydrooctyl)triethoxysilane ($C_6F_{13}CH_2CH_2Si(OEt)_3$) dissolved in ethanol was applied by the dip coating process using the dip coating device shown in FIG. 9 to form a coat composed of said sol dispersion, the coat was dried at 50° C., followed by subjecting to heat treatment at 300° C. to thereby convert the coat into a metal oxide film as a surface protective layer. Then, on the surface of the metal oxide surface protective layer, a coating composition comprised of a chlorotrifluoroethylenevinyl ether copolymer resin having an acid value of 3 mg KOH/g and a hydroxyl value of 44 mg KOH/g, dicuminyl peroxide as a crosslinking agent and xylene as a solvent was applied by the spray coating process using the spray coating device shown in FIG. 8 in an amount to provide a thickness of about 0.5 μm when dried, followed by drying at 60° C. for 30 minutes, to thereby form a fluorine-containing resin layer having a thickness of about 0.5 μm on the metal oxide surface protective layer.

Thus, there was obtained en electrophotographic photosensitive member.

The electrophotographic photosensitive member was set to the electrophotographic apparatus shown in FIG. 10, wherein the image-forming process was continuously conducted 500,000 times under conditions of 500 mm/sec for the image-forming process speed and 10 g/cm for the blade pressure upon conducting cleaning for the surface of the electrophotographic photosensitive member. As a result, all the 500,000 copied products obtained were found to be excelling in image quality.

Comparative Example 2

The procedures of Example 4 were repeated, except that the crosslinking agent used upon the formation of the fluorine-containing resin layer was replaced by blocked isocyanate, to thereby obtain an electrophotographic photosensitive member.

The resultant electrophotographic photosensitive member was evaluated in the same manner as in Example 4.

As a result, some of the 500,000 copied products were found to be accompanied by wavy defects.

TABLE 1

| film forming conditions | layer constitution: charge injection inhibition layer | photo-conductive layer | surface layer |
|---|---|---|---|
| raw material gas and its flow rate | | | |
| $SiH_4$ | 200 sccm | 400 sccm | 20 sccm |
| $H_2$ | 500 sccm | 500 sccm | 0 sccm |
| $B_2H_6$ | 2000 ppm | 0.5 ppm | 0 ppm |
| NO | 10 sccm | 0 sccm | 0 sccm |
| $CH_4$ | 0 sccm | 0 sccm | 500 sccm |
| substrate temperature | 250° C. | 250° C. | 250° C. |
| inner pressure | 0.5 torr | 0.5 torr | 0.5 torr |
| RF power applied | 100 W | 500 W | 100 W |
| layer thickness | 3 μm | 20 μm | 0.5 μm |

TABLE 2

| film forming conditions | layer constitution: charge injection inhibition layer | photo-conductive layer | surface layer |
|---|---|---|---|
| raw material gas and its flow rate | | | |
| $SiH_4$ | 350 sccm | 350 sccm | 70 sccm |
| $H_2$ | 100 sccm | 100 sccm | 100 sccm |
| $B_2H_6$ | 1000 ppm | 0 ppm | 0 ppm |
| NO | 10 sccm | 0 sccm | 0 sccm |
| $CH_4$ | 0 sccm | 0 sccm | 350 sccm |
| substrate temperature | 250° C. | 250° C. | 250° C. |
| inner pressure | 4.0 mtorr | 4.0 mtorr | 4.0 mtorr |
| RF power applied | 1000 W | 1000 W | 1000 W |
| layer thickness | 3 μm | 20 μm | 0.5 μm |

What we claim is:

1. A process for producing an electrophotographic photosensitive member, said process comprises the steps of:

providing a product in process for an electrophotographic photosensitive member comprising a substrate, a light receiving layer having a photoconductive layer composed of a non-single crystal material containing silicon atoms as a matrix and having photoconductivity disposed on said substrate;

subjecting the surface of said light receiving layer of said product in process to plasma treatment in a gas atmosphere comprised of a fluorine-containing gas to have a contact angle against water of 80° or more;

applying a sol dispersion comprising an organometallic compound admixed with water, an alcohol and an acid onto the surface of the light receiving layer; and subjecting the resultant to heat treatment to form a metal oxide film as a surface protective layer on the surface of the light receiving layer whereby obtaining an electrophotographic photosensitive member.

2. The process according to claim 1, wherein the fluorine-containing gas is selected from carbon fluoride and derivatives of said carbon fluoride.

3. The process according to claim 1, wherein the fluorine-containing gas comprises at least one selected from the group consisting of $CCl_3F$, $CCl_2F_2$, $CBrClF_2$, $CClF_3$, $CBrF_3$, $CF_4$, $CHClF_2$, $CHF_3$, $C_2Cl_4F_2$, $C_2Cl_3F_3$, $C_2Cl_2F_4$, $C_2ClF_5$, $C_2F_6$, $C_2H_3ClF_2$, $C_2H_4F_2$, $C_2H_4F_2$, and $C_3F_8$.

4. The process according to claim 1, wherein the gas atmosphere contains at least a gas selected from the group consisting of an inert gas and $H_2$ gas.

5. The process according to claim 4, wherein the inert gas is Ar gas or He gas.

6. The process according to claim 1, wherein the plasma treatment is conducted at a vacuum of 0.3 Torr to 0.7 Torr.

7. The process according to claim 1, wherein the plasma treatment is conducted at a temperature of room temperature to 200° C.

8. The process according to claim 1, wherein the sol dispersion was applied by a dip coating process or a spray coating process.

9. The process according to claim 1, wherein the organometallic compound comprises a metal alkoxide.

10. The process according to claim 1, wherein the organometallic compound comprises an acetylacetonate.

11. The process according to claim 9, wherein the metal alkoxide is an organometallic compound represented by the general formula: $M(OR)_n$, with n being an integer of more than 1, M being a metal atom, and R being a $C_nH_{2n-1}$ group or a $C_6H_6$ group.

12. The process according to claim 11, wherein the metal atom is selected from Na, Al, Ti, Mn, Fe, Co, Si, Zn, Zr, Y, and Eu.

13. The process according to claim 4, wherein the metal alkoxide is dissolved in an alcohol and hydrolyzed.

14. The process according to claim 1, wherein the sol dispersion applied is made to provide a thickness as much as 100 to 500 times over the thickness of the metal oxide film to be obtained.

15. The process according to claim 1, wherein the metal oxide film is made to have a thickness of 0.01 μm to 5 μm.

16. The process according to claim 1, wherein the metal oxide film comprises a compound selected from the group consisting of $SiO_2$, $Al_2O_3$, ZnO, $TiO_2$, $Fe_3O_4$, $Co_3O_4$, NiO, and CuO.

17. The process according to claim 1, wherein the organometallic compound contains fluorine atoms.

18. The process according to claim 1, wherein a layer comprising a fluorine-containing resin layer is formed on the surface protective layer.

19. The process according to claim 18, wherein the fluorine-containing resin comprises a copolymer comprising of chlorofluoroethylene and vinyl monomer.

20. The process according to claim 19, wherein the copolymer has an acid value of 2 or more.

21. The process according to claim 19, wherein the copolymer has a hydroxyl value of 50 or less.

22. The process according to claim 19, wherein the copolymer is crosslinked using an peroxide.

23. The process according to claim 19, wherein the copolymer is a copolymer of chlorotrifluoroethylene and vinyl monomer.

24. The process according to claim 22, wherein the peroxide is an organic peroxide.

25. The process according to claim 22, wherein the peroxide is added to the copolymer in an amount of 0.5 wt. % to 5 wt. %.

26. The process according to claim 19, wherein the copolymer contains an acid component.

27. The process according to claim 26, wherein the acid component is a compound selected from the group consisting of (metha)acrylic acid, maleic acid, fumarlic acid, oleic acid, and dibasic acid anhydride.

28. The process according to claim 18, wherein the fluorine-containing resin layer is made to have a thickness of 0.01 μm to 5 μm.

29. The process according to claim 18, wherein the fluorine-containing layer is formed by a dip coating process or a spray coating process.

30. The process according to claim 10, wherein the acetylacetonate has a fluorine radical in the side chain thereof.

* * * * *

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 1

Line 22, "assurred." should read --assured.--.

COLUMN 2

Line 7, "a" should read --an--.

COLUMN 3

Line 2, "a manner in which" should be deleted.
Line 42, "cess," should read --cesses,--.

COLUMN 4

Line 24, "solgel" should read --sol-gel--.
Line 62, "a image" should read --an image--.
Line 63, "uneveness" should read --unevenness--.

COLUMN 5

Line 9, "wastes." should read -waste.--.
Line 15, "damage" should read --damaging--.
Line 51, "wastes" should read --waste--.

COLUMN 6

Line 43, "to to" should read --to--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 7

Line 25, "electrophotograohic" should read --electrophotographic--.

COLUMN 8

Line 11, "wastes" should read --waste--.
Line 39, "illustration" should read --illustrating--.
Line 50, "corresponds" should read --corresponds to--.

COLUMN 9

Line 15, "repelleny" should read --repellency--.
Line 63, "FIG. 2(A)," should read --FIG. 3(A),--.

COLUMN 10

Line 4, "FIG. 2(B)," should read --FIG. 3(C),--.
Line 9, "FIG. 1(B)," should read --FIG. 3(D),--.
Line 34, "be be" should read --be--.

COLUMN 11

Line 8, "In" should read --in--.
Line 12, "To" should read --to--.
Line 13, "pattern. The" should read --pattern, the--.
Line 15, "The" should read --the--.
Line 17, "The" should read --the--.
Line 33, "The" should read --the--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 12

Line 6, "group v" should read --group V--.
Line 8, "group v" should read --group V--.
Line 62, "(0)" should read --(O)--.

COLUMN 13

Line 22, "group v" should read --group V--.
Line 37, "via" should read --VIa--.

COLUMN 14

Line 16, "group v" should read --group V--.
Line 50, "(this" should read --(these--.

COLUMN 15

Line 13, "1X10⁻to" should read --$1X10^{-1}$ to--.
Line 36, "(0)" should read --(O)--.
Line 47, "contained" should read --be contained--.
Line 55, "(0)" should read --(O)--.
Line 56, "atoms" should read --atom--.
Line 60, "Thereof" should read --thereof--.
Line 64, "The" should read --the--.

COLUMN 16

Line 42, "capable" should read --capable of--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 17

Line 12, "introduce" should read --to introduce--.
Line 14, "Or" should read --or--.
Line 30, "$Si_{2F6}$," should read --$Si_2F_6$,--.

COLUMN 18

Line 12, "deosition" should read --deposition--.
Line 47, "gase" should read --gas--.

COLUMN 19

Line 42, "capable" should read -capable of--.
Line 49, "capable" should read -capable of--.
Line 59, "AlL" should read --All--.
Line 64, "depositio" should read --deposition--.
Line 66, "gase" should read --gas--.

COLUMN 20

Line 54, "chain represented by the general" should read --chain.--.
Line 55, line 55 should be deleted.
Line 56, "those Na," should read --those represented by the general formula: $M(OR)_n$, with M being Na,--.
Line 66, "$(C_{14}H_{19}F_{13}O_3Si)$," should read --$(C_{14}H_{19}F_{13}O_3Si)$, (3,3,3-trifluoropropyl) methyldimethoxysilane--.
Line 67, "$(C_6H_{13}F_3O_2Si)_n$," should read --$(C_6H_{13}F_3O_2Si)$,--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 21

Line 1, "$(C_6H_{13}F_3O_2Si)$, and" should read --$((C_4H_7F_3O_2Si)_n$,--.
Line 3, "ti-containing" should read --Ti-containing--.

COLUMN 22

Line 50, "proncipally" should read --principally--.

COLUMN 23

Line 20, "ester" should read --ether--.
Line 23, "flororesin)" should read --fluororesin)--.

COLUMN 24

Line 7, "Mount" should read --amount--.
Line 44, "glutalic" should read --glutaric--.

COLUMN 25

Line 37, "dure" should read --due--.

COLUMN 26

Line 2, "nether" should read --neither--.
Line 30, "of" (first occurrence) should be deleted.
Line 32, "nether" should read --neither-.
Line 48, "dipped is first" should read --is first--.
Line 60, "and" should read --any--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 27

Line 3, "of of" should read --of--.
Line 10, "etch" should read --etching--.
Line 16, "$C_2Cl_2F^4$," should read --$C_2Cl_2F_4$,--.
Line 36, "cause" should read --caused--.
Line 59, "electrophotograpic" should read --electrophotographic--.
Line 61, "The" should read --the--.

COLUMN 28

Line 5, "electrophotophotographlc" should read --electrophotographic--.
Line 10, "mark x," should read --mark X,--.
Line 15, "charger" should read --charge- --.
Line 16, "moving" should read --removing-.
Line 25, "mirrors 1031," should read --mirrors 1013,--.
Line 37, "that that" should read --that--.

COLUMN 29

Line 37, "composed" should read --composed of--.
Line 65, "film" should read --film,--.

COLUMN 31

Line 61, "net" should read --not--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL. Page 7 of 9

It is certified that error appears in the above-identified patent and that said Letters Patent is hereby corrected as shown below:

COLUMN 32

Line 6, "organ metallic" should read --organometallic--.

COLUMN 35

Line 17, "member." should read --members.--.
Line 27, "member." should read --members.--.

COLUMN 36

Line 16, "convert" should read --convert it--.

COLUMN 37

Line 5, "shown in" (second occurrence) should be deleted.
Line 16, "shown in" (second occurrence) should be deleted.
Line 41, "shown in" should be deleted.
Line 52, "shown in" (second occurrence) should be deleted.

COLUMN 38

Line 46, "$(Si(OC_2HS)_4)$" should read --$(Si(OC_2H_5)_4)$--.

COLUMN 39

Line 62, "having an about 0.5 μm" should read --about 0.5 μm thick--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 40

Line 1, "ration" should read --ratio--.
Line 2, "bolls" should read --balls--.
Line 22, "an" should read --a--.
Line 32, "of" should be deleted.
Line 37, "of" should be deleted.

COLUMN 41

Line 11, "was" should read --was set--.
Line 35, "vacuum" should read --a vacuum--.

COLUMN 43

Line 39, "roethylenevinyl" should read --roethylene-vinyl--.
Line 48, "en" should read --an--.

COLUMN 44

Line 45, "comprises" should read --comprising--.

COLUMN 45

Line 29, "claim 4," should read --claim 9,--.

UNITED STATES PATENT AND TRADEMARK OFFICE

CERTIFICATE OF CORRECTION

PATENT NO. : 5,561,021

DATED : October 1, 1996

INVENTOR(S) : KOJI YAMAZAKI ET AL.

It is certified that error appears in the above-identified patent and that said Letters Patent is hereby corrected as shown below:

COLUMN 46

Line 8, "of" should be deleted.
Line 14, "an" should read --a--.
Line 28, "fumarlic" should read --fumaric--.

Signed and Sealed this

Twenty-fifth Day of March, 1997

Bruce Lehman

*Attest:*

BRUCE LEHMAN

*Attesting Officer*

*Commissioner of Patents and Trademarks*